US010619377B2

(12) United States Patent
Beisser, III

(10) Patent No.: US 10,619,377 B2
(45) Date of Patent: Apr. 14, 2020

(54) T-BRACE SYSTEM

(71) Applicant: Franz X Beisser, III, Bedford, VA (US)

(72) Inventor: Franz X Beisser, III, Bedford, VA (US)

( * ) Notice: Subject to any disclaimer, the term of this patent is extended or adjusted under 35 U.S.C. 154(b) by 561 days.

(21) Appl. No.: 15/298,263

(22) Filed: Oct. 20, 2016

(65) Prior Publication Data

US 2017/0167160 A1 Jun. 15, 2017

Related U.S. Application Data

(60) Provisional application No. 62/243,869, filed on Oct. 20, 2015, provisional application No. 62/323,175, filed on Apr. 15, 2016.

(51) Int. Cl.
*E04H 17/08* (2006.01)
*E04H 17/26* (2006.01)
*E04C 3/02* (2006.01)

(52) U.S. Cl.
CPC ..... *E04H 17/08* (2013.01); *E04H 17/266* (2013.01); *E04C 2003/026* (2013.01)

(58) Field of Classification Search
CPC ..... E04H 17/08; E04H 17/22
USPC ..... 256/30, 31, 35, 36, 63, 64
See application file for complete search history.

(56) References Cited

U.S. PATENT DOCUMENTS 1,017,833 A * 2/1912 White ..... E04H 12/08 235/131 R
1,159,856 A * 11/1915 Michod ..... E04H 17/22 52/150
1,183,499 A * 5/1916 Slaven ..... E04H 17/08 256/35
1,735,101 A * 11/1929 Ziebarth ..... E04H 17/08 52/152
3,674,243 A 7/1972 Brown
4,349,181 A * 9/1982 Asher ..... E04H 17/08 256/22
4,763,879 A * 8/1988 Wasicek ..... E04H 17/08 256/36
4,889,322 A * 12/1989 Wagner ..... E04H 17/08 256/36
4,979,724 A * 12/1990 Williams ..... E04H 17/08 256/36
5,046,705 A * 9/1991 Williams ..... E01F 7/02 256/36
5,061,109 A 10/1991 Miller
5,192,055 A * 3/1993 Griggs ..... E04H 17/22 248/354.1
5,996,973 A * 12/1999 Campbell ..... E01F 9/685 256/31
6,536,745 B2 * 3/2003 Roark ..... E04H 17/08 256/65.01
6,705,598 B2 * 3/2004 Collins ..... E04H 17/08 256/35

(Continued)

*Primary Examiner* — Matthieu F Setliff
(74) *Attorney, Agent, or Firm* — IPLC Group PLC; Anthony Tacconi, Esquire

(57) ABSTRACT

A system to be used in t-post fence arrangements. The system comprises an adjustable locking brace having two specialized ends which permit the brace to be used in a variety of bracing configurations. The system further includes hinge pins for connecting a gate to a t-post fence. Other devices and apparatus are provided which further assist in the building and maintenance of t-post fences.

5 Claims, 24 Drawing Sheets

(56) References Cited

U.S. PATENT DOCUMENTS

| | | | | |
|---|---|---|---|---|
| 6,883,785 | B1 * | 4/2005 | Knapp | A01K 3/00 256/1 |
| 7,108,249 | B2 | 9/2006 | Bechtel | |
| 8,480,061 | B2 * | 7/2013 | Graves | E04H 17/20 248/220.21 |
| 9,328,530 | B2 * | 5/2016 | Bailey | E04H 17/08 |
| 2003/0038281 | A1 * | 2/2003 | Roark | E04H 17/08 256/63 |
| 2003/0042475 | A1 * | 3/2003 | Passafuma | E04H 17/08 256/35 |
| 2003/0066995 | A1 * | 4/2003 | Collins | E04H 17/08 256/35 |
| 2013/0256619 | A1 * | 10/2013 | Bailey | E04H 17/08 256/35 |

* cited by examiner 1605
1606

1604
1602
1603
1601

1607
1609
1608

1612
1611
1610
1613

1803
1802
1801
1818
1820
1816
1817
1819
1800
1807
1806
1805
1808
1809
1804
1810
1815
1814
1813

T-BRACE SYSTEM

This application claims priority from U.S. Provisional Patent Application Nos. 62/323,175 filed on Apr. 15, 2016 and 62/243,869 filed on Oct. 20, 2015.

FIELD OF THE INVENTION

The present invention relates to fence installation and construction, and, more specifically to t-post fence bracing elements, hinge pins, and other related elements and equipment, and methods of use thereof.

BACKGROUND OF THE INVENTION

Agricultural fences and similar fencing enclosures are often constructed using metal posts having a t-shaped cross-section, generally known as t-posts. These t-posts can be used as the principal supporting structure of both temporary and permanent fences. T-posts are often used in straight-run fencing but are not used for corners or bracing posts. Fences incorporating such t-posts are considerably less expensive, and generally easier and faster to install, than fences using wooden posts as anchors. Wooden posts, however, are often required for corners and bracing purposes. Power equipment is typically used to install such wooden posts. In addition, wooden fence posts are often sunk into concrete for added stability and reinforcement. Longer fences which cover greater areas may require substantial reinforcement and bracing. Accordingly, installation of a large number of wooden posts using power equipment and concrete can be costly and time-consuming. Finally, wooden posts have a finite life span which is exceeded by that of metal t-posts. Extending a fence around a large area of land generally requires the assistance of several persons and machinery in order to complete the task.

Using wooden posts for corners and bracing fence posts can present certain other challenges. Wooden posts must be braced, typically with other horizontal wooden posts and diagonal steel cables, in order to properly stretch, and attach, fencing material between the posts. In addition, bracing is often necessary in fences which follow a curved path or are any length beyond fifty or so yards. Finally, due to the forces acting upon corner and support posts, both at installation and during the life of the fence, it is essential that such corner elements be adequately braced.

There is, therefore, a need for a fencing system that allows one person to install a complete, reinforced fence without the need for additional manpower, heavy equipment, or other assistance.

OBJECT OF THE INVENTION

It is an object of the invention to provide a fence bracing system which can be installed by a single person. It is a further object of the invention to provide a fencing system in which no wooden posts are required. It is a further object of the invention to provide a system which can be used to assist in building a t-post fence without the need for heavy equipment or heavy machinery. It is a further object of the invention to provide a system which can be used to assist in building a t-post fence with the fewest components possible, without the need for multiple clamps or brackets and hand tools.

Additional objects of the invention are to create braced corners in fences, to brace metal posts on a straight-run, as well as on an uphill or downhill fence, to assist in running fencing around trees or through wooded areas using all metal posts, to assist in running fencing into or through creeks and small streams by "reverse bracing" posts from bottom up, and to assist in the installation and bracing of gates in t-post fencing.

SUMMARY OF THE INVENTION

The present invention teaches a fence bracing system, i.e., an apparatus and method, to brace or support t-posts which are used to construct what is commonly known as a t-post fence. The system eliminates the need for cumbersome and potentially expensive wooden posts and braces for fence corners and for post bracing in straight-line fencing. The system permits a single user to brace and install a fence for a small to moderate area without the need for additional manpower or assistance, extensive tools, or heavy equipment. The system includes a plurality of locking brace elements which snap into place and serve to brace the t-posts in the fence. The locking brace elements include a narrow key-fork end and a wide angle-lock fork end. The respective ends, when applied using the method disclosed herein, are designed to be mounted at various positions on a t-post and provide secure bracing for fence posts in straight-runs, in corners, and in conjunction with gates. The various applications discussed herein, such as straight-line bracing, corner bracing, and reverse bracing, all rely upon the novel locking function of the brace element. The system can be used with a t-post fence strung with barbed wire, chain link fence, and similar fence that comes in a roll. The invention further includes specialized upper and lower gate pins for attaching a gate to a t-post and a wire-stretch bracket which further assists in stretching fencing wire from t-post to t-post.

DETAILED DESCRIPTION

The invention consists of various elements which, when used according to the system provided herein, form a fencing system which serves to assist a user in installing and bracing a t-post type fence. The fundamental component of the system is a locking brace element. The system also includes specialized upper and lower gate pins, and a wire-stretch bracket.

Figure 1:
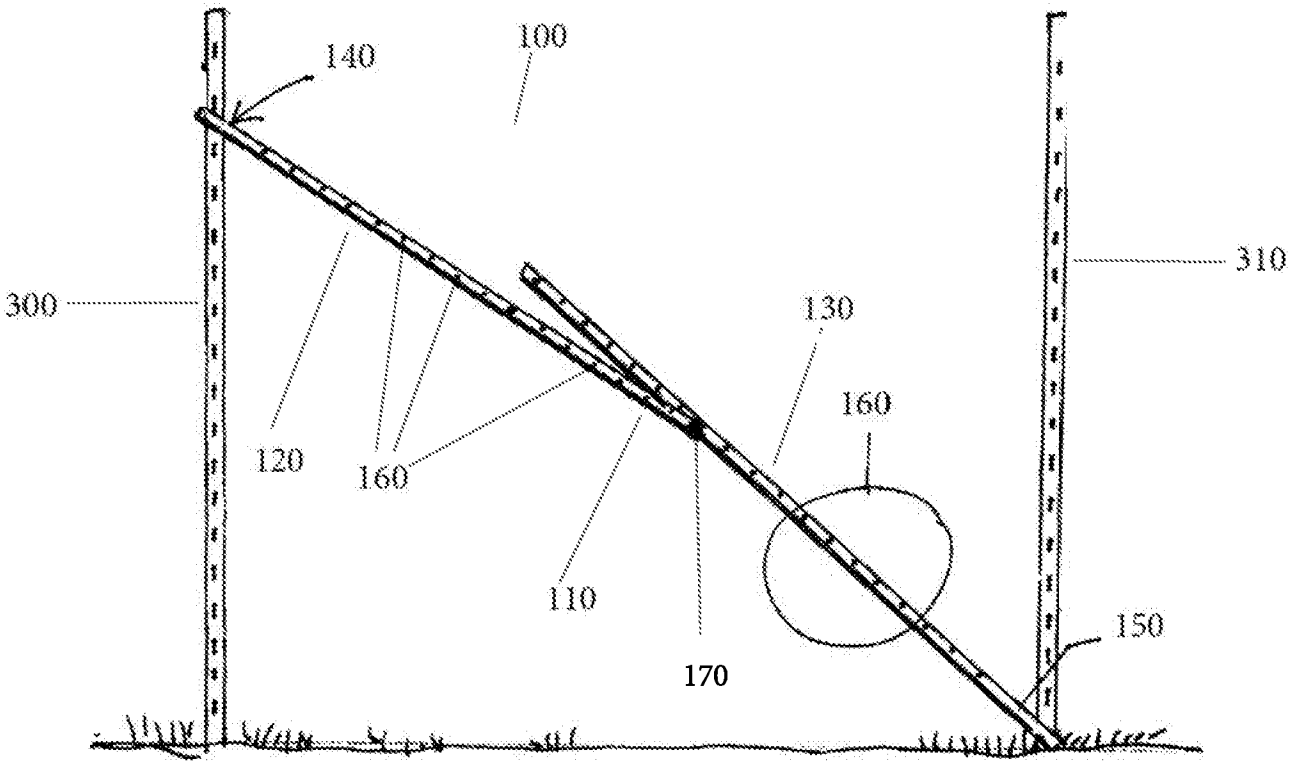
FIG. 1 is front view of the bracing system when in use.

The locking brace element 100, also referred to as a t-brace, can be seen in FIG. 1. When in use, the locking brace element 100 is rigidly fixed to one or more t-posts to provide support for such posts. The locking brace element 100 comprises an elongated, L-shaped body 110, formed of metal in the preferred embodiment, which is comprised of two sections, a key-lock section 120 and a wide angle-lock section 130. The key-lock section 120 terminates in a key-lock fork 140. The angle-lock section 130 terminates in a wide-angle fork 150. A plurality of adjustment apertures or holes 160 are longitudinally spaced from one another at substantially regular intervals along the length of the bracing element body 110. In the preferred embodiment, the adjustment holes are positioned every two inches. The positioning of the holes away from the bend of the bar's L-channel is calculated to assure that when locked together, the two portions of the body 110 are flat on top of one another in order to transfer strength without placing extra stress on the locking bolt.

The two sections of the body, the key-lock section 120 and angle-lock section 130, are joined by a hinge pin 170, which is a removable nut and bolt. The bolt of the hinge pin 170 passes through apertures 160, on both the first and second portions of the bracing element 100, which have been axially aligned, i.e., the apertures 160 in each section are aligned such that the bolt of the hinge pin 170 can pass through the corresponding aperture on each section in order to connect the two sections 120, 130. It will be recognized that the hinge pin may be positioned within any pair of aligned apertures in order to create the hinge at any desired point. The placement of the hinge pin 170 can be used to adjust the overall length of the bracing element 100. Further, the hinge pin 170 allows limited rotation about the bolt such that the sections 120, 130 may be folded onto each other for ease of storage and transport. The locking brace 100 also includes a locking bolt and wing nut 175 (not shown in FIG. 1) for rigidly securing the body when in operation.

Figure 2:
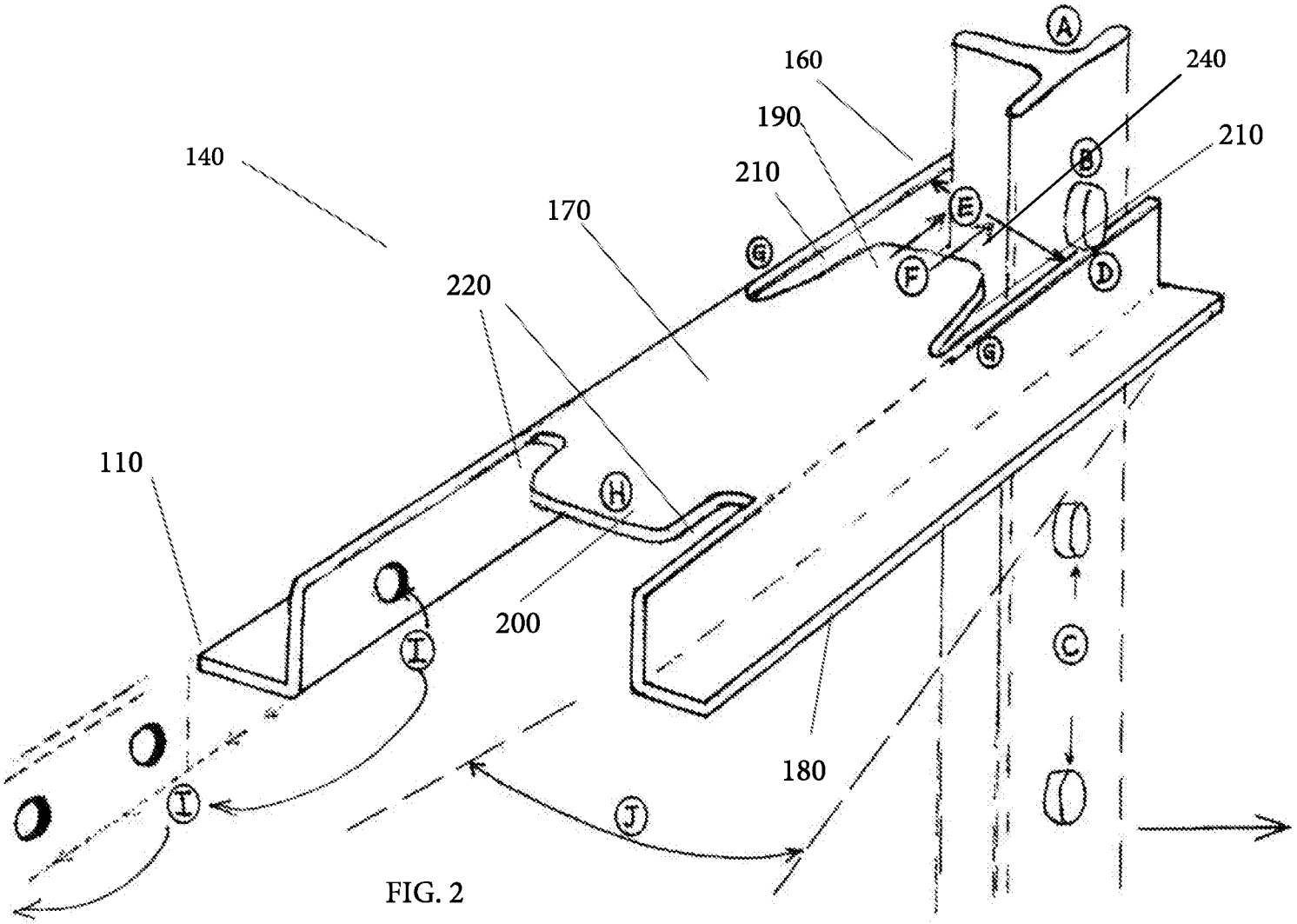
FIG. 2 is a perspective view of the key-lock fork on a bracing element.

As seen in FIG. 2, the narrow key-lock fork 140 is formed by a first-end 160 of the body 110, a center portion 170, and a flange 180. The center portion 170 extends orthogonally from the edge of body 110 and is essentially flat with a forward tongue 190 and a rear tongue 200. When in use, the forward tongue 190 applies pressure to the curvature of the t-post, thereby strengthening the bracing function. This tongue also allows a user to utilize the key-fork to twist a t-post that may have been driven slightly out of alignment with the fence line. The tongue 190 further allows the locking brace to be installed from either direction on a t-post. The rear tongue 200, which is shorter than the forward tongue 190, serves to stabilize a t-post and locking brace when the locking brace is used for horizontal bracing.

The extension of the upper tongue from the center portion 170 results in the formation of two upper channels 210. The upper channels keep the key-lock fork locked into place when the locking brace is angled down in use. These channels also assist with various other bracing functions. The extension of the lower tongue from the center portion 170 results in the formation of two lower channels 220. When in use, the key-lock fork 140 secures the locking brace 100 to the narrow dimension of a standard t-post. The fork width E is of such dimensions that the lock space 240 is able to slide under the knob of a standard t-post and will clear the other side of the t-post by approximately 1/16 of an inch. The key-lock fork 140 may be composed of separate pieces or formed integrally with the body 110. The key-lock fork 140 engages the t-post when locking pressure is applied at ninety degrees or at any smaller angle, down to forty-five degrees to the t-post at contact pressure point.

Figure 3:
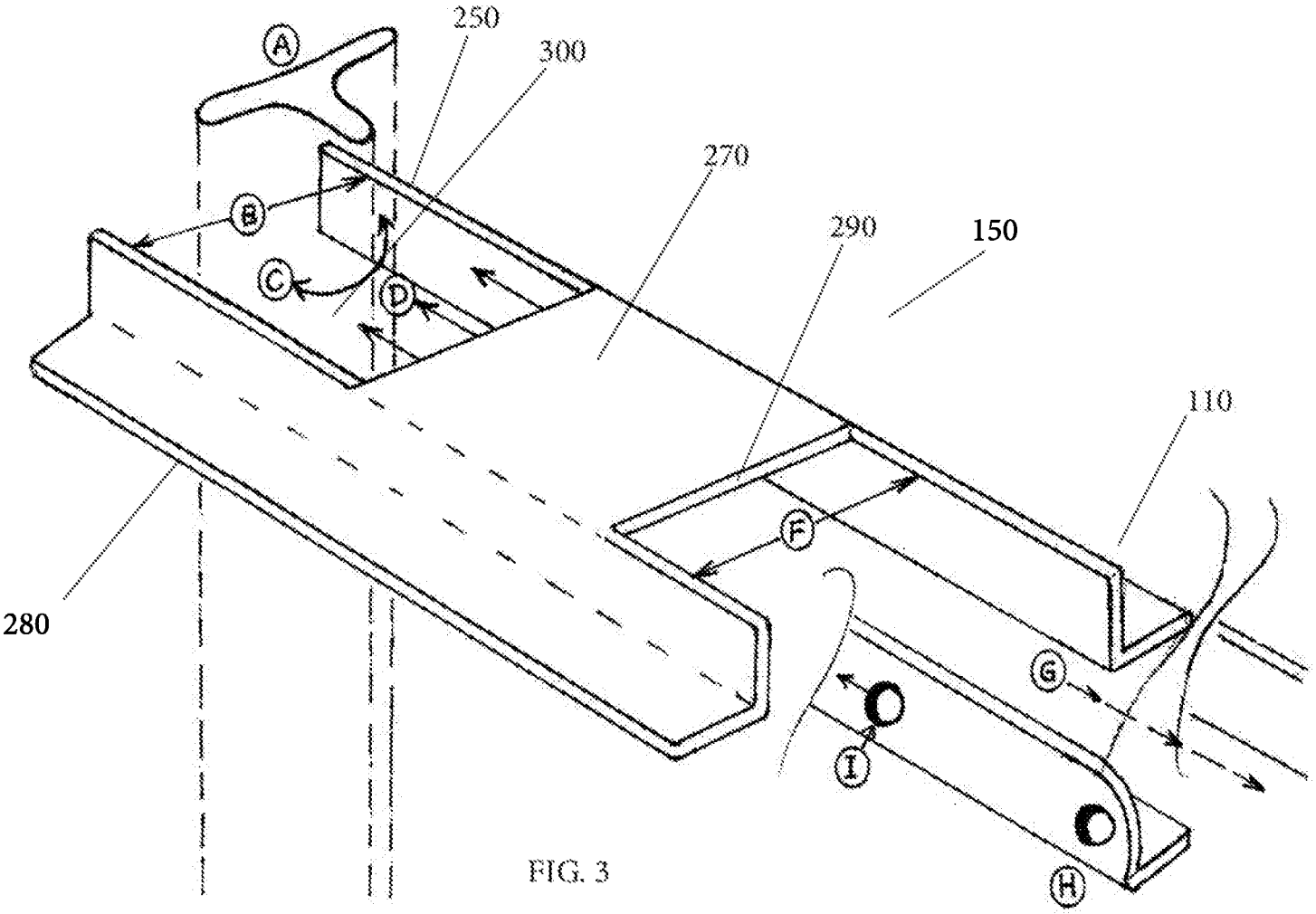
FIG. 3 is a perspective view of the angle-lock fork on a bracing element.
Figure 8:
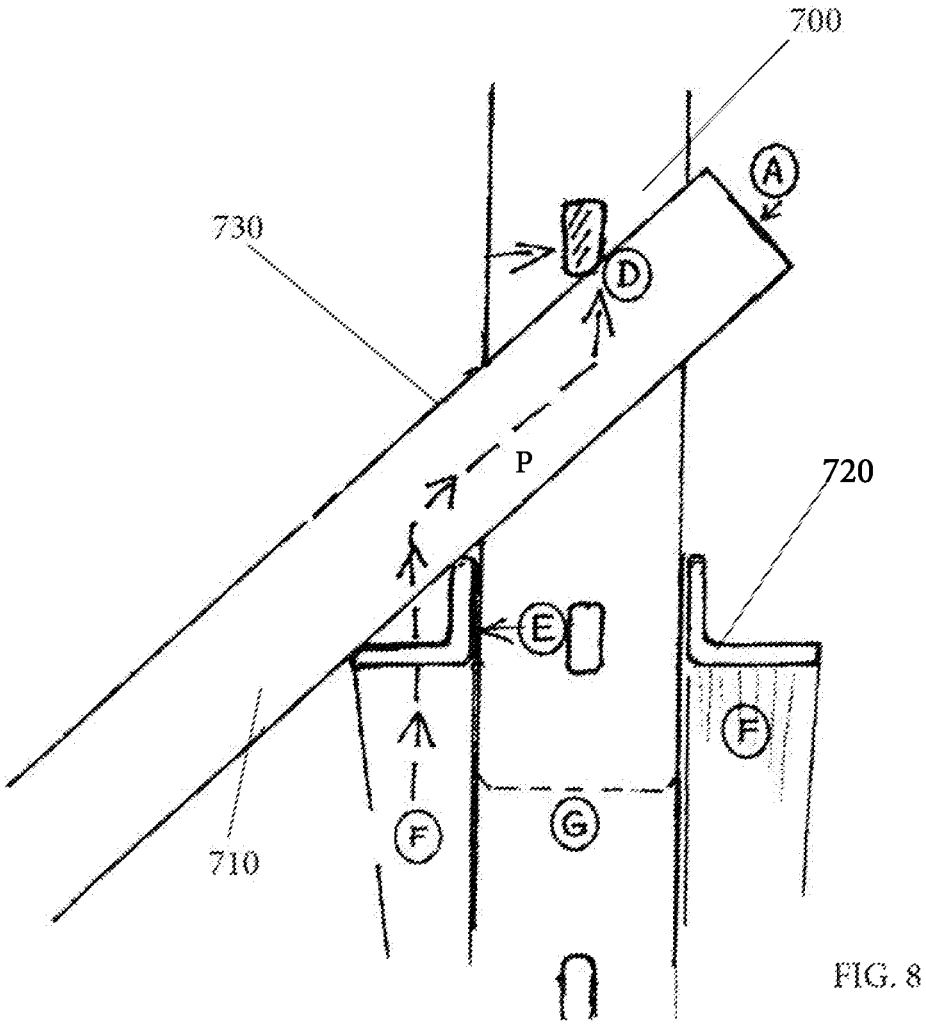
FIG. 8 is a close-up side view of a corner post braced using the invention.

Referring now to FIG. 3, the wide-angle fork 150, also referred to as the rotating angle fork, is formed by the second end 250 of the L-shaped body 110, a center portion 270, and a flange 280. The center portion 270 extends orthogonally from the edge of the body 110 and has two parallel edges which run perpendicular with the longitudinal axis of the body 110 and of the flange 280. The wide-angle fork 150 is wider than the key-lock fork and as wide as the widest portion of a conventional t-post. This permits the wide-angle fork, when inserted under the key-lock fork, to provide support for corners in any direction in the fence, as shown in FIG. 8. The wide-angle fork serves as a wide stop at ground level on a t-post in order to insure that the brace will not loosen over time. The width B of the lock space 300 is sufficient to clear the widest dimension of a t-post, as indicated above. The rear edge 290 of the wide-angle fork serves as a point of contact on the wide-angle fork when the brace is being used for horizontal bracing. The rear edge 290 is forcibly engaged with the t-post under the t-post knob in horizontal corner bracing or gate bracing. The wide-angle fork 150 may be composed of separate pieces or formed integrally with the body 110.

The holes 160 on the key lock portion 120 match the holes in the wide-angle fork section 130 when the two sections are slid together and the brace element is set. The locking holes in the two sections are situated such that when the locking bolts are in place, the channels on each section are flush with one another, thereby eliminating pressure on the locking bolts. This section of doubled-up channels adds strength to the center portion of the brace, reducing the tendency for it to bend under pressure. The holes are placed in such a position that when the locking bolts are inserted the octagonal heads of the bolt will not rotate when being secured with the wing nut. This added feature eliminates the need for the use of tools.

A basic bracing arrangement, through the use of one bracing element 100 disposed between first and second t-posts 300, 310, is illustrated in FIG. 1. These t-posts, as are all of those used with this invention, are conventional t-posts which are embedded into the ground. Once the hinge pin 170 is positioned within the desired adjustment hole 160, the bracing element 100 is placed into position between the first and second t-posts 300, 310. As seen in FIG. 1, in this configuration, the locking brace is used in diagonal position between the posts. The key-lock fork 140 is secured to the upper portion of the first t-post 300 and the angle lock fork 150 is secured to the bottom of the second t-post 310. The bracing element 100 may be oriented base-to-tip between the posts in either direction, subject to the limitation of the locking mechanisms on the bracing element 100. In this case, once the bracing element 100 is placed into the desired position, pressure is applied to a portion 315 of the second element which brings the locking brace into its aligned and locked position. The locked position is maintained by placing a lock bolt with wing nut 175, and tightening same, in an adjustment hole 160.

Figure 4A:
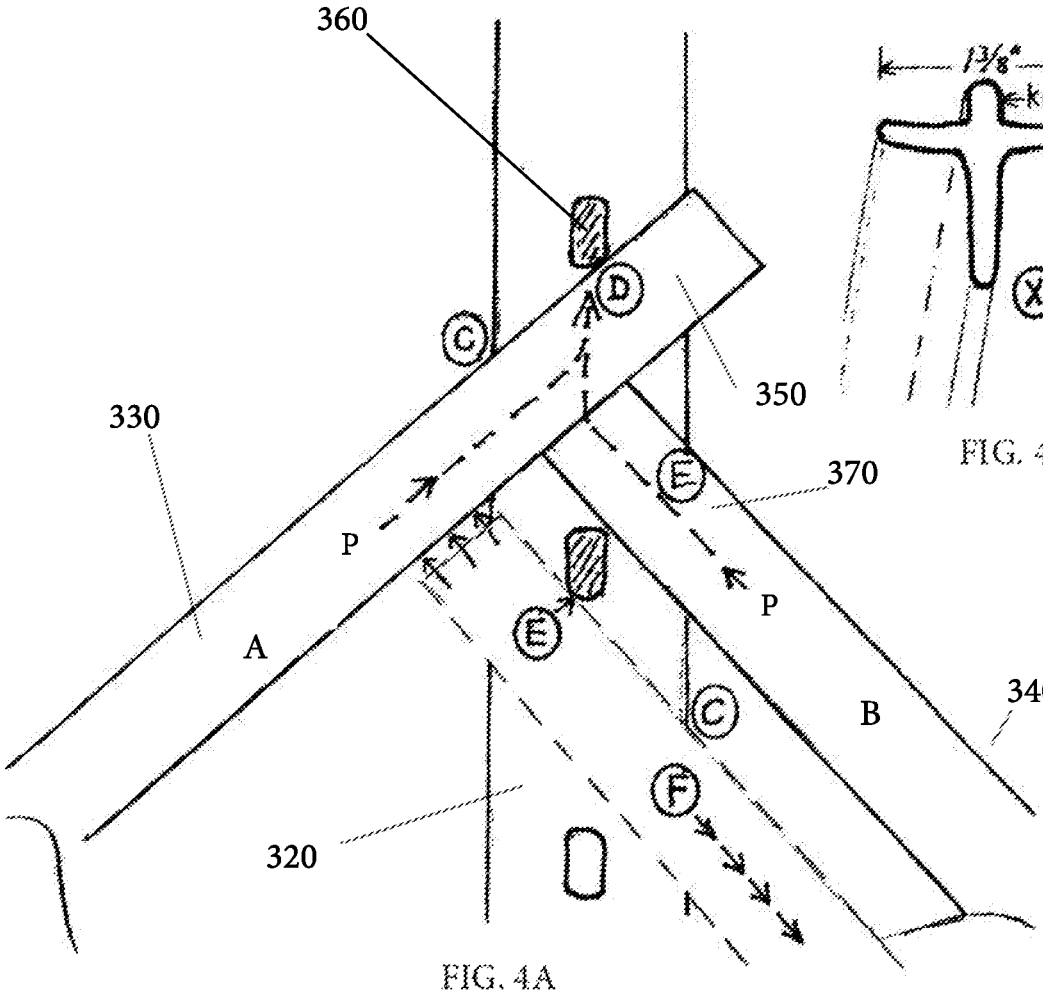
FIG. 4A is a close-up planar view of a t-post having two bracing elements attached thereto.
Figure 4B:
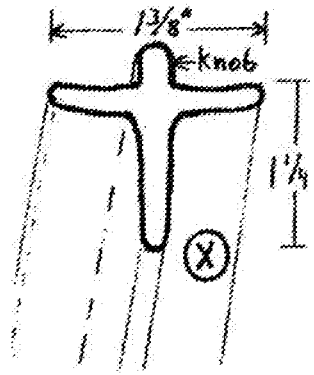
FIG. 4B is a perspective view of the end of a t-post.

FIG. 4A illustrates the mechanics of the bracing mechanism in standard, straight-run bracing. In FIG. 4A, t-post 320 is being braced by a first locking brace 330, and a second locking brace 340. The key-lock fork 350 of the first locking brace 330 is in the primary bracing position under t-post knob 360. The key-lock fork slides in the narrow part of the t-post (shown in FIG. 4(*b*)). Once the opposite end of the first-locking brace is properly mounted, force or pressure will be exerted along the length of the locking brace, as shown by arrows A, which forces the locking brace into a secured position under the knob 360. As shown, a second locking brace 340 may be secured to the t-post 320 in a conventional straight run bracing scenario. In such a case, second locking brace 340, is mounted on the t-post. This second locking brace 340 is positioned under the first brace 330 and, when mounted, may exert an upward force on the first locking brace as shown by arrows B. This upward force serves to further secure the first locking brace 330 in position. It will be noted that while the second locking brace is secured immediately below, and in contact with, the first locking brace in FIG. 4, it could be installed further down on the t-post 320 at a position where it is not in contact with the first locking brace 330 in order to reach the next t-post in a fence going down a hill.

The key-lock fork 140 is used to secure the bracing element to the narrow dimension of a standard t-post. Referring again to FIGS. 1 and 4, the key-lock 140 is secured in place by first orienting the bracing element 100 in a location approximately ninety degrees from the long (vertical) axis of the t-post 320. The key-lock 140 is pushed forward onto the t-post 320 just below a knob 350 until the tongue 190 (shown in FIG. 2) is in contact with the t-post 320. The key-lock fork slides under the knob and clears the other side of the t-post (the face opposite the knob) by approximately $1/16^{th}$ of an inch (1.5875 mm). In a standard three-post brace, the bracing element is then angled down resulting in an upward force, shown in FIGS. 4 and 5, which assists in securing the key lock fork 140 under the t-post knob. When the situation permits, or requires, the locking brace 100 can be mounted such that the body 110 is positioned on the outside of the t-post, i.e., on side of the t-post opposite that which has the fencing wire secured to it. This orientation prevents the body from obstructing the knobs of the t-post which could be problematic when stretching wire between the two braced t-posts.

The preferred embodiment includes two principal straight run bracing configurations, the three post "W" configuration and the two post "X" configuration. In a normal fence run, the t-posts are often placed about the length of a t-post apart (about 6 feet apart). The locking brace does, however, include a hinge pin which is movable along the length of the locking brace. This permits a certain amount of adjustment in order to accommodate t-posts that are spaced closer or further apart than the typical six foot spacing.

Straight Run Bracing

Figure 5:
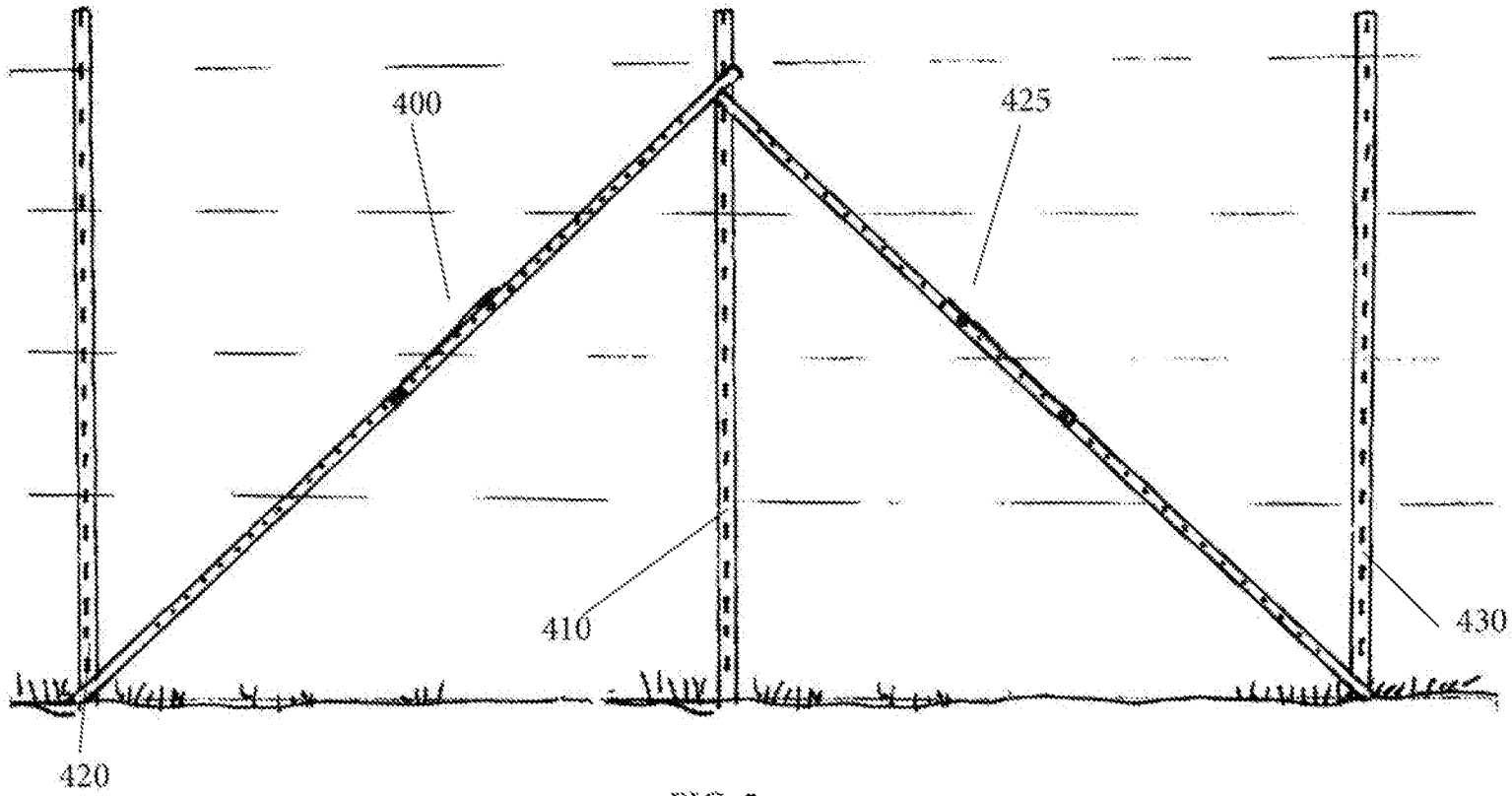
FIG. 5 is a front view of straight-run bracing using the invention.

In the preferred embodiment, straight-run bracing of a center t-post is accomplished via a three post "W" bracing arrangement as shown in FIG. 5. This is accomplished by placing the key-lock fork (narrow fork) of a first locking brace 400 on the upper end of a first t-post 410 (which is the center post). The wider end (the other fork) of the first locking brace 400 is placed down near the bottom of the second t-post 420 (outside left post). The hinge on the first locking brace 400 is pushed down to align the two sections of the first locking brace 400. The position bolt of the first locking brace 400 is slid through the desired hole and a wingnut is secured on the end of the bolt, thereby, locking the first locking brace 400 in place.

The key-lock fork of the second locking brace element 425 is then mounted towards the top of the center post 410 and the wide fork on the bottom of a third post 430 (outside right post). The second brace can be mounted with the wide-angle fork under brace 400 with the key-lock fork at the bottom of an adjoining t-post in order to have the brace bar away from the stretched fence wire. The second brace 425 is also closed, aligned, and then secured by the position bolt in the same fashion as the first locking brace 400. This results in an adequately braced center post 410 that can be stretched against, when installing fencing, in either direction along the fence line.

Figure 6:
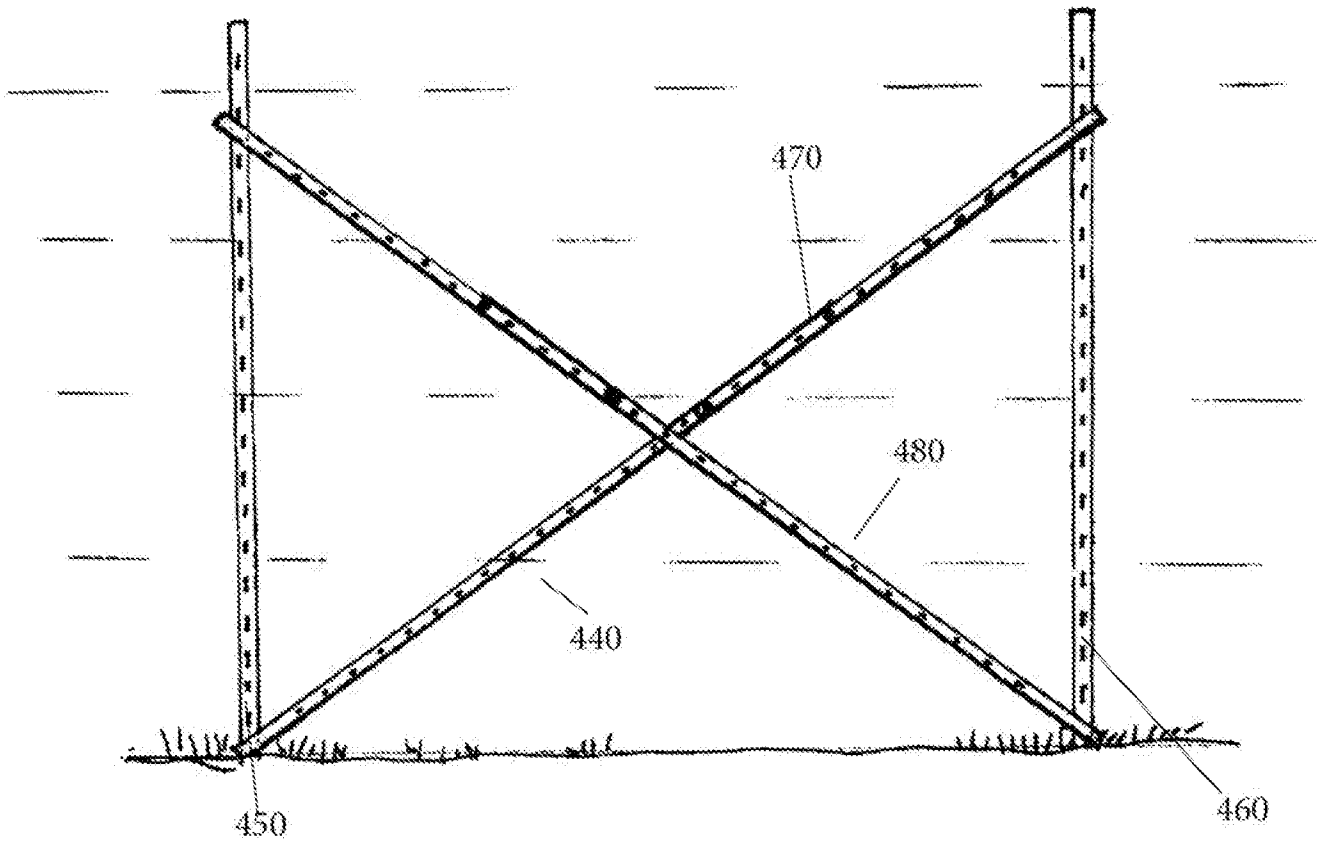
FIG. 6 is a front view of an alternate embodiment of straight-run bracing using the invention.

Straight-run bracing can also be accomplished through the use of X-bracing, as shown in FIG. 6. In this configuration, it only takes two posts to accomplish the same stretching as in the three post straight-run bracing. The first locking brace 440 is installed between a first post 450 and a second post 460. It is generally preferable, to mount the first locking brace 440 such that the body 470 is behind the t-posts 450, 460 in order to avoid any interference with the fence wire when it is being stretched and installed. The fence wire is then stretched from the post 460 to post 450. Once the fence wire is secured, the second locking brace 480 is installed between the posts 450, 460 over the fence wire. The fence wire can then be stretched from the post 450 further along the fence. In this scenario, the locking braces 440, 480 would typically be installed from the bottom up, and, accordingly, a user would push up, rather than push down to align and lock the two sections of each locking brace.

Corner Bracing

Figure 7:
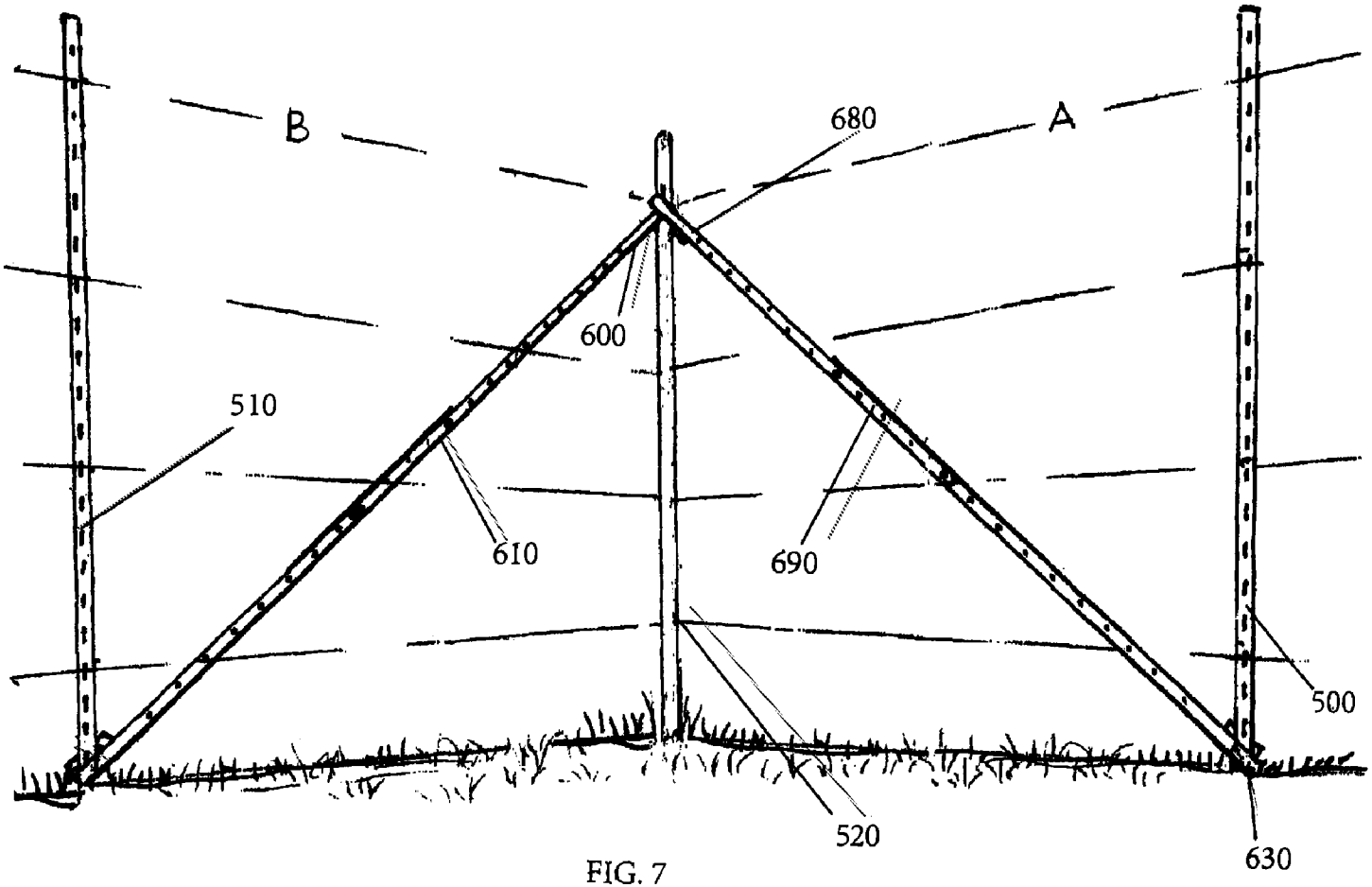
FIG. 7 is a front view of corner bracing using the invention.

The locking braces can be used to brace a corner t-post from any angle. In a typical scenario, a fence would run along a first fence line, enter a corner, and then emerge to run along a second fence line which would lie at approximately a right angle relative to the first fence line. As seen in FIG. 7, this bracing configuration involves a first bracing t-post 500 (in fence line A), a second bracing t-post 510 (in fence line B), a corner t-post 520, and two locking braces 610, 690. In the preferred embodiment, the corner post 520 is positioned such that the t-post knobs are facing out, in line with the fence-line A, i.e., away from the area being enclosed by the fencing, so one can wrap the wire around the outside braced corner post. If the wire were to be run in front, it would have to be held by conventional wire clips which could pop off when the fence wire is tightened. In the embodiment shown herein, the wire is being held against the braced corner post.

As shown in FIG. 7, the key-lock 680 of first locking brace 690 is mounted on the top of the corner post 520 and angle-lock fork 630 of the locking brace 690 is mounted on the bottom of the first bracing t-post 500. Pressure is then applied to the middle of the first locking brace 690 and this locks the two sections into place. Since the corner post 520 is sideways (relative to the second t-post 510 which is at a right angle), one must use the angle-lock side 600 on the second locking brace 610. The angle-lock fork 600 of locking brace 610 goes on the top of the corner post 520, just below the key lock portion 680 of the first brace 690; this configuration uses the first locking brace 690 as a stop and prevents the second locking brace 610 from being forced off of the corner post 520 once it is mounted. The narrow key lock portion of the second locking brace then goes to the bottom of the second-bracing t-post 510. The second locking brace 610 is then also locked into place.

FIG. 8 illustrates the basic mechanics of corner bracing using the invention. Corner post 700 is being braced via first locking brace 710 and second locking brace 720. The locked position of the key lock fork 730 of the first locking brace becomes the stop for further horizontal or right angle bracing. In this embodiment, the corner post 700 is right-angle braced from the back side of the t-post 700 (the side opposite the knobs) by the angle-fork of the second locking brace 720, which is pressed up against the key-lock fork 730 of the first brace 710.

No diagonal wires are needed in the corners as are often required in conventional wood-post fencing arrangements. A corner post braced in this fashion is able to resist considerable lateral forces pulling along the fence line in either direction.

Reverse Bracing

The system is also designed for another configuration, reverse bracing, which can be used in situations in which a t-post in a fence line is positioned below the general fence line, typically in a soggy or wet gully, small stream, or on a depressed surface. In conventional arrangements, which do not employ reverse bracing, the overall wire tension of the fence generally applies an upward force upon the lower positioned t-post. Over time, this pressure tends to uproot the t-post which compromises the integrity of the fence.

Figure 9:
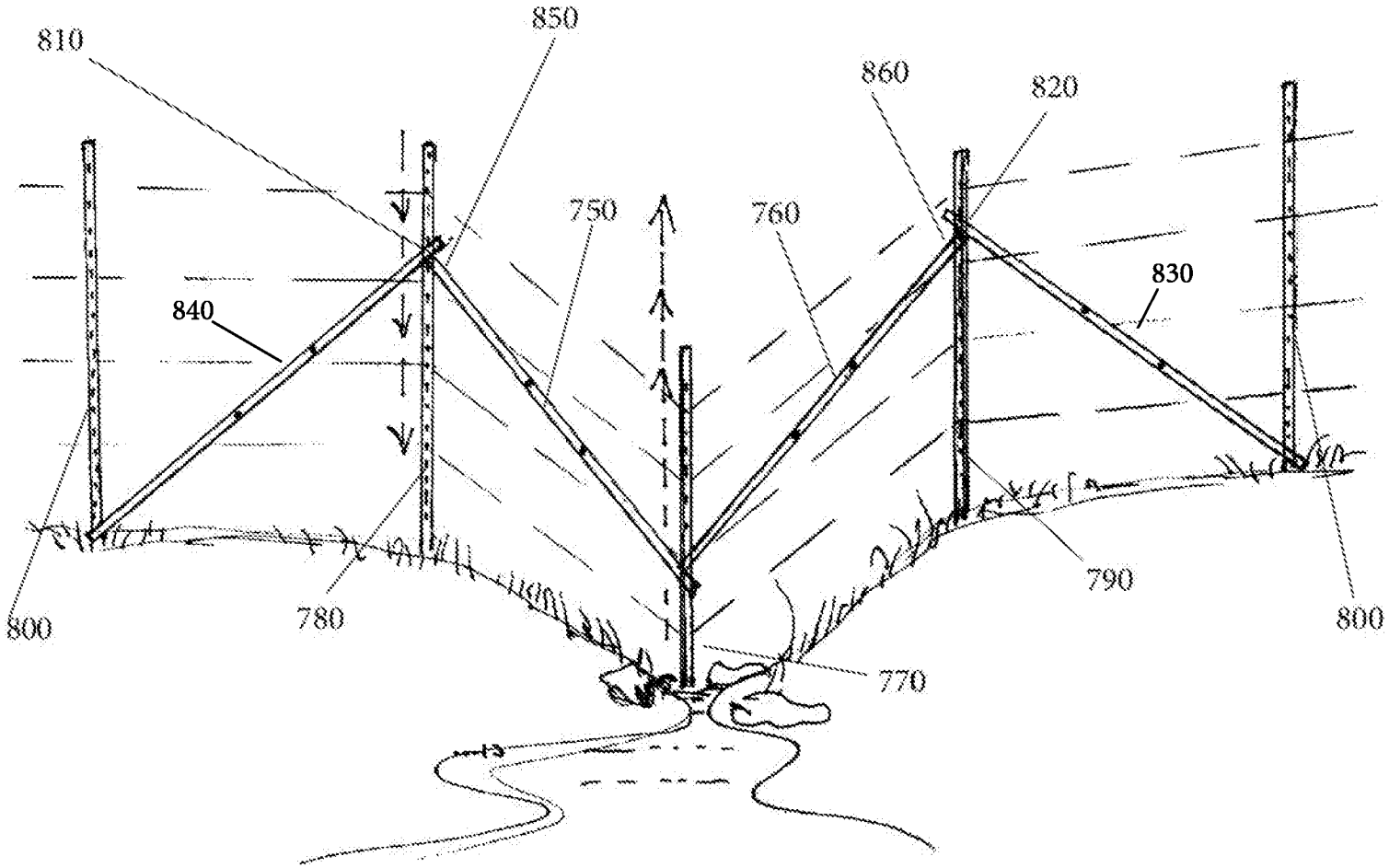
FIG. 9 is an illustration of reverse bracing using the invention.

Under these circumstances, the fence can be reverse braced using four bracing elements as shown in FIG. 9 to insure that the depressed post is not pulled up by the force of the stretched fence wire. The t-posts are braced from the bottom-up with the key-lock forks being on the bottom. The angle-lock fork of each locking brace is held by a locked t-post which is within the normal fence line, e.g., outside the gully or ravine.

More specifically, in this configuration, two bracing elements 750, 760 are secured to the t-post 770 in the gully or wet ground. Unlike in the prior configurations, the key lock forks of the two bracing elements 750, 760 are positioned on the lower portion of the t-post 770. The bracing elements 750, 760 then extend to the two respective t-posts 780,790 which are located on higher ground. T-posts 780,790 are then braced by successive t-posts 800 along the fence line. The second set of brace elements is oriented in a standard configuration: the key lock forks 810, 820 are positioned on the top portion of the t-posts. The key lock forks on the lower portion of the sunken post prevent that post from riding upward when pressure is applied.

Further, the key lock forks 810, 820 of the additional bracing elements 830, 840 lock the angle-lock forks 850, 860 into place and force (upward force that may be exerted by the sunken post) is ultimately transmitted from the wide angle forks to the bracing elements and then the other t-posts 800. This prevents the angle-lock forks 850, 860 from riding up and off of the bracing t-posts.

Brace Extension

An extension bar may also be utilized in order to provide the ability to shorten the overall length of the locking brace for shipping and ease of use. This can also be used to reduce the weight of the locking brace when used in smaller applications, such as backyard fencing and gardening.

Figures 9A, 9B, 9C, 9D, 9E, 9F:
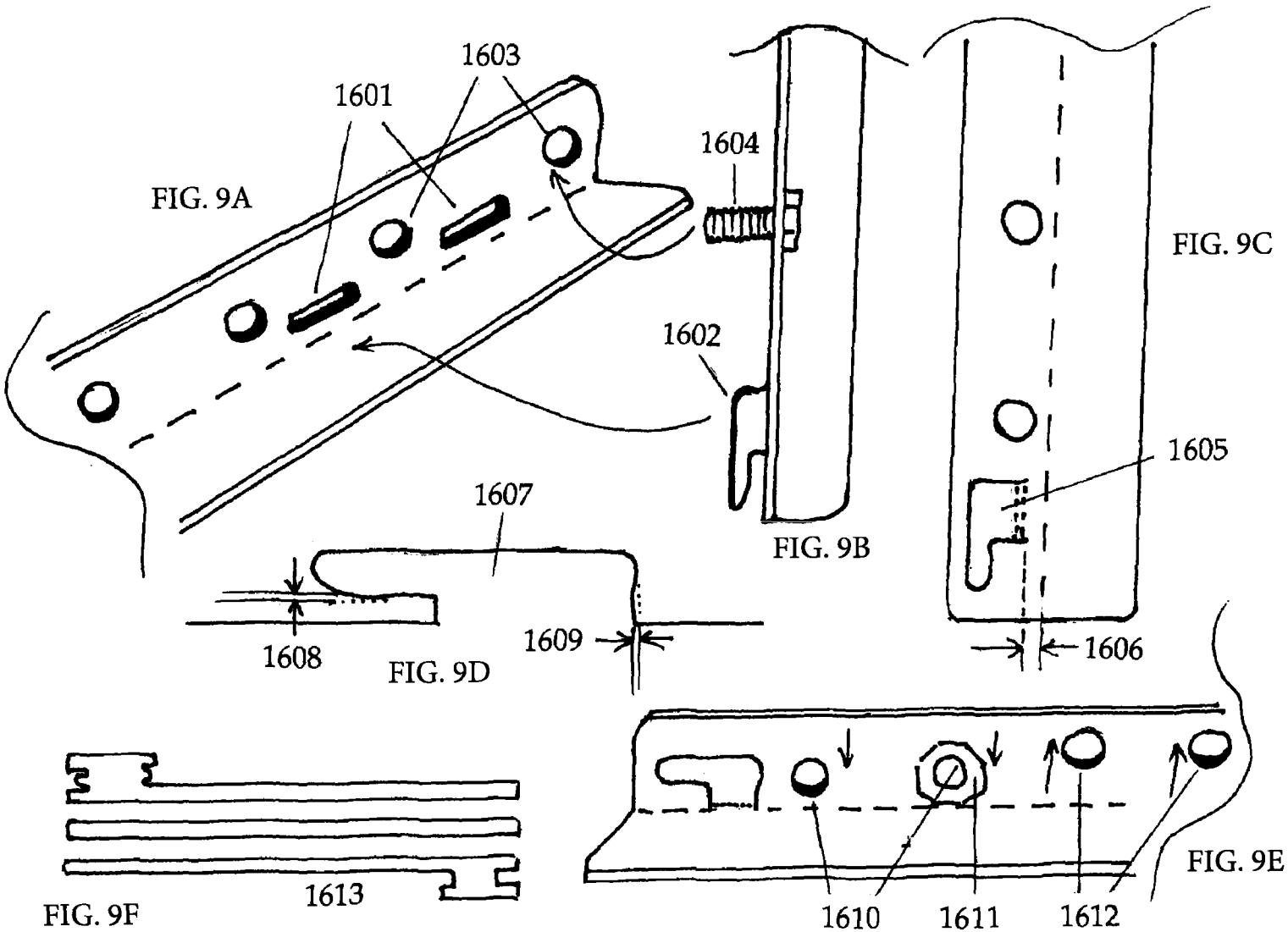
FIG. 9A shows a first portion of an extension bar.
FIG. 9B shows a second portion of an extension bar.
FIG. 9C shows a third portion of an extension bar.
FIG. 9D shows a fourth portion of an extension bar.
FIG. 9E shows a fifth portion of an extension bar.
FIG. 9F shows a sixth portion of an extension bar.

Referencing FIG. 9A, the extension bar is designed to be positioned between a key-lock portion bar 1650 and a wide-fork portion bar 1660. In part A, the end 1670 of the key-lock portion is shown having two slots 1601 disposed to receive a hook 1602 on the extension bar B which is snapped in to the end of the fork bar. Each slot 1601 has a corresponding hole 1603 which may receive a bolt 1604 and locking nut (not shown). Part C is a flat view of the bar before an angle bar is formed. The hook 1605 is positioned slightly off-center 1606, i.e., off the center bend, to assure it will grab the flat segment for strength. Part D is an enlarged side view of the locking hook. As seen in part E, the bolt holes used for the extension connection 1610 are located below the brace locking holes. This permits a user to insert a locking bolt from the inside of the locking bar's L-channel while holding the bolt's head to keep it from turning when the wing nut on the outside of the bar is tightened. The locking holes on the extension bar are located at the same positions and with the same spacing as on the key lock portion 1650 and the wide lock portion 1660. This assures normal adjustment and fixation when the extension is in place and the brace is assembled. The positioning of the locking holes away from the bend of the bar's L-channel is calculated to assure that when locked together, the key lock portion bar 1650 and the wide lock portion bar 1660 are flat on top of one another in order to transfer strength from the key lock portion bar 1650 to the wide lock portion bar 1660 without placing extra stress on the locking bolts.

Fencing Around an Obstacle

The system can be used to reinforce t-posts that are positioned around an obstacle, such as a tree, which is obstructing the path of the fence. In this arrangement, for instance, two locking braces are used to brace an outlying t-post which sits beyond an otherwise generally straight fence line. The outlying t-post is braced with a first locking brace such that the key-fork of the first locking brace is on top relative to the second locking brace, i.e., the key-fork is positioned above the second t-brace which is also attached to the outlying t-post and is also being used to brace the outside post from the other direction. This orientation prevents the top locking brace from being pushed off the outlying t-post by the second locking brace which is positioned underneath the first locking brace.

Hinge Pins and Gate Attachment/Bracing

Figure 10:
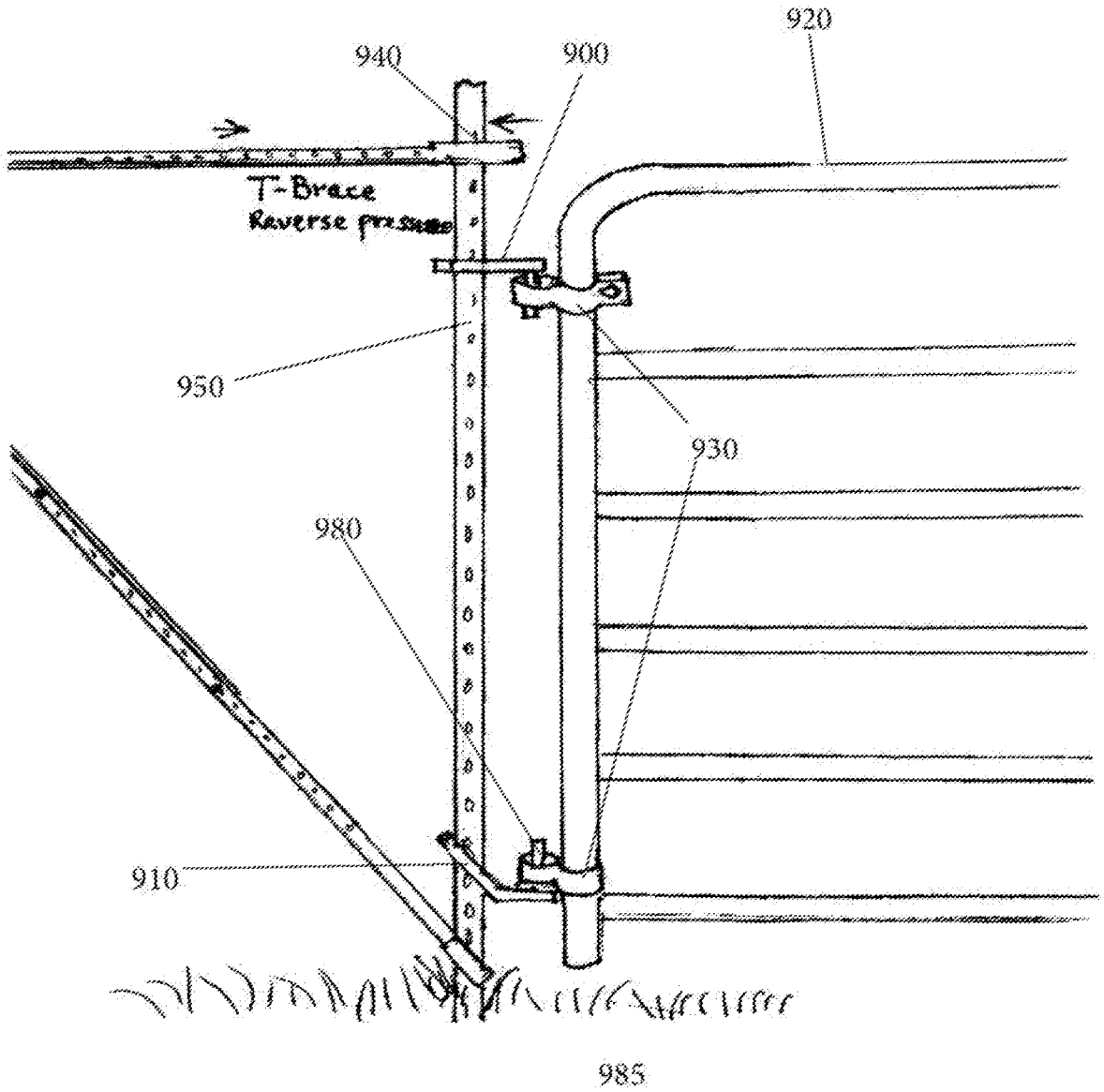
FIG. 10 shows a front view of a gate braced using the invention.
Figure 11:
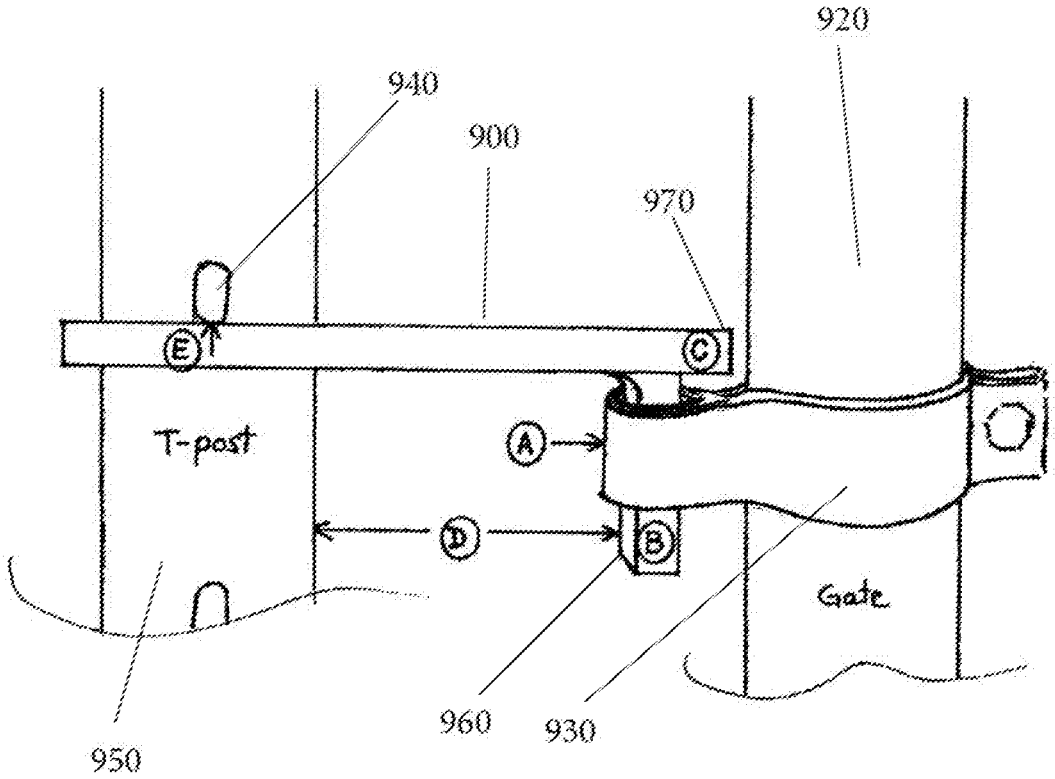
FIG. 11 is a side view of the upper gate pin when installed.
Figure 12:
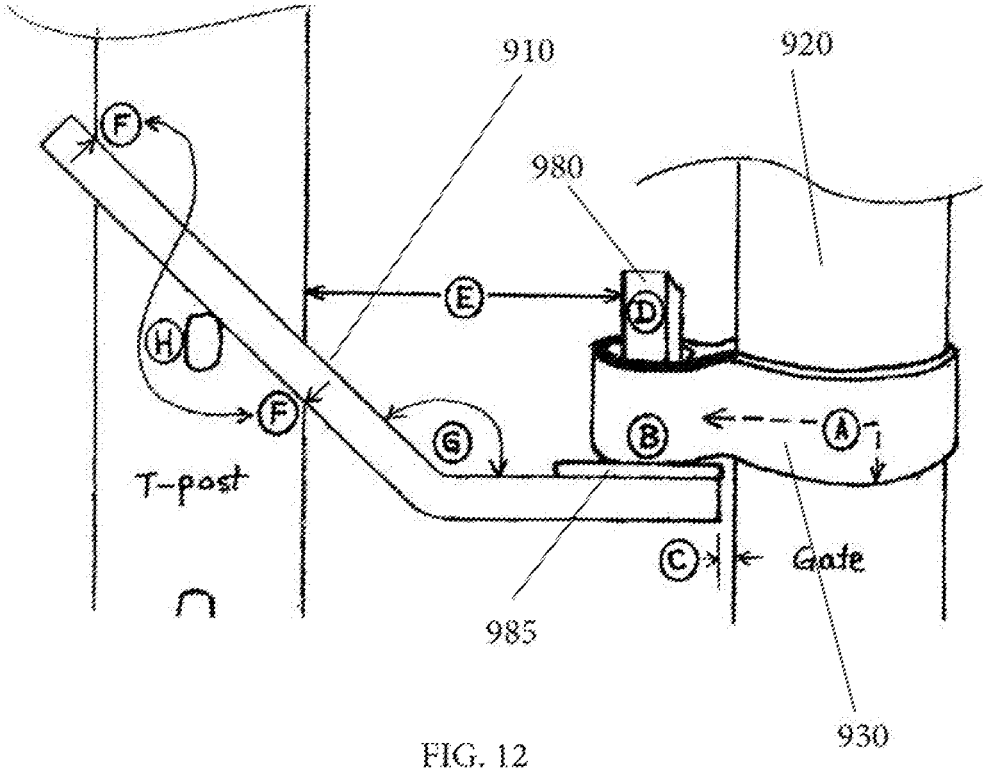
FIG. 12 is a side view of the lower gate pin when installed.

The system includes components, and a method of using those components, which can be used to attach a gate to a t-post, in particular to a t-post which has been reinforced using one or more locking brace elements. As seen in FIGS. 10-12, gate attachment is accomplished with the use of two gate pins, an upper gate pin 900 and a lower gate pin 910. It will be recognized that in order to attach the gate 920 to the gate pins 900, 910, the gate must have two mounting brackets, loops, or other such structures 930 disposed to receive the projections from the respective gate pins as do standard farm gates.

As seen in FIGS. 10 and 11, the pressure of the hanging gate 920 secures the upper gate pin 900 under the knob 940 of the t-post 950 and prevents it from sliding up on the post. The length of the pin projection 960, which extends beyond the mounting bracket 930, further strengthens the coupling. The rounded protrusion 970 of the gate pin, best seen in FIG. 13, guides the gate such that it can be opened to over 105 degrees from the closed position in either direction. In a locked position, the upper gate pin 900 is lined up vertically with the lower gate pin 910 and both gate pins are equidistant from the t-post 950.

As seen in FIGS. 10 and 12, the lower gate pin 910 is also mounted on a t-post knob and further includes a pin projection 980. As seen in FIG. 12, the pressure A of the hanging gate is down and towards the t-post 950. The gate bracket rests on washer 985 thereby evenly applying downward pressure for smoother rotation of gate 920. When the gate pin is used with a worn gate, and the space indicated by —C— is not present, the rounded pipe shape of the gate will allow the gate to rotate smoothly on the washer and rounded side edge of the pin, preventing further wear. The extra height of pin projection 980 reduces the likelihood of the gate 920 from being accidentally lifted off of the lower gate pin.

The distance between the t-post and a locked lower gate pin exactly matches the distance between the t-post and a locked upper gate pin. This places both gate pins in a vertical position to the t-post thereby minimizing wear. When tilted, the lower gate pin's thickness rests against the wings of the t-post, securely locking the lower gate pin 910 into the correct position. The angle of bend of the lower gate pin 910, in conjunction with both pressure points of —F—, guarantees that the pin projection 980 will sit parallel to post. When locked, the knob on the t-post keeps the lower gate pin from slipping down on t-post.

Figure 13:
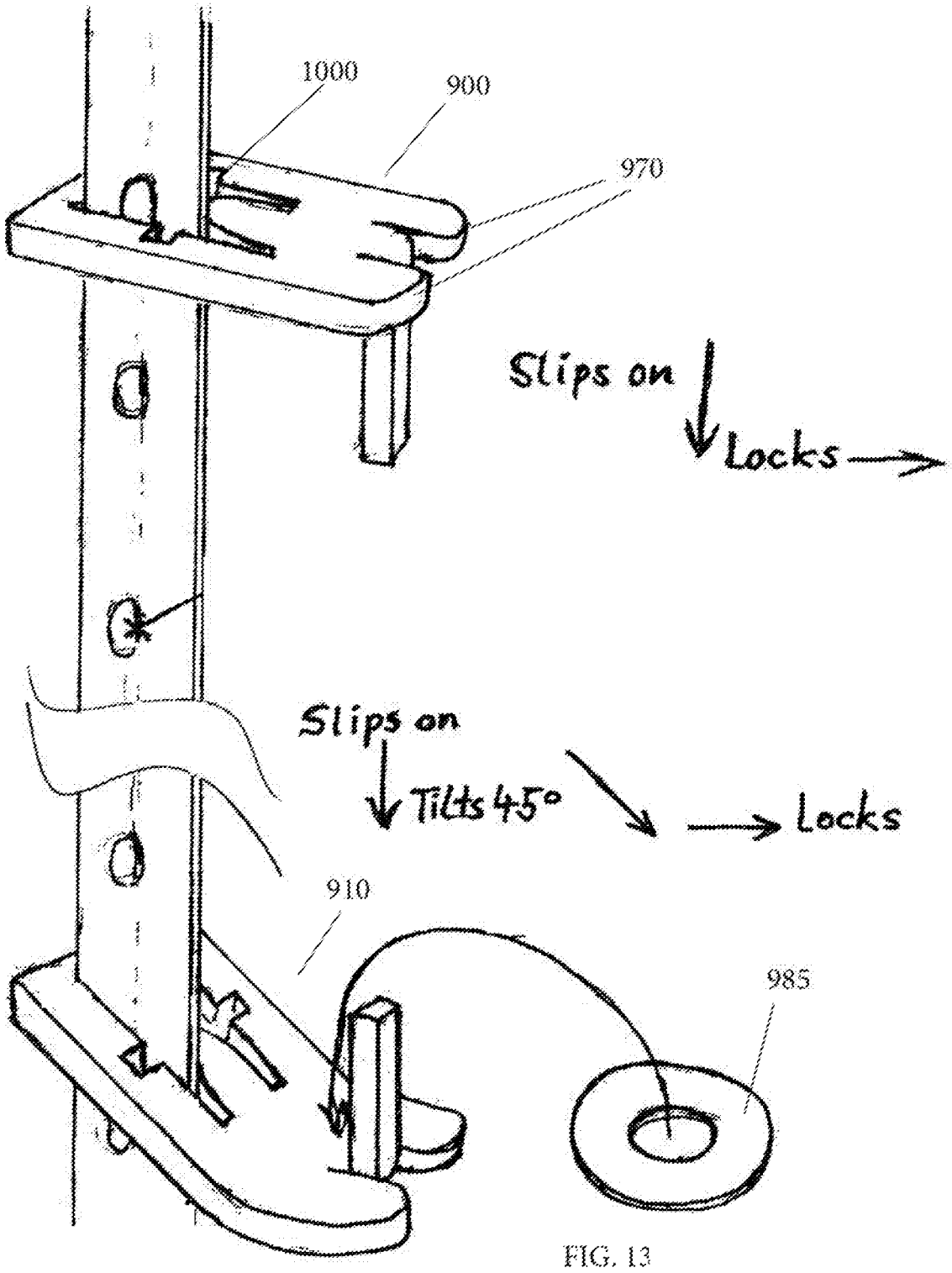
FIG. 13 is a perspective view of the gate pins.
Figure 14:
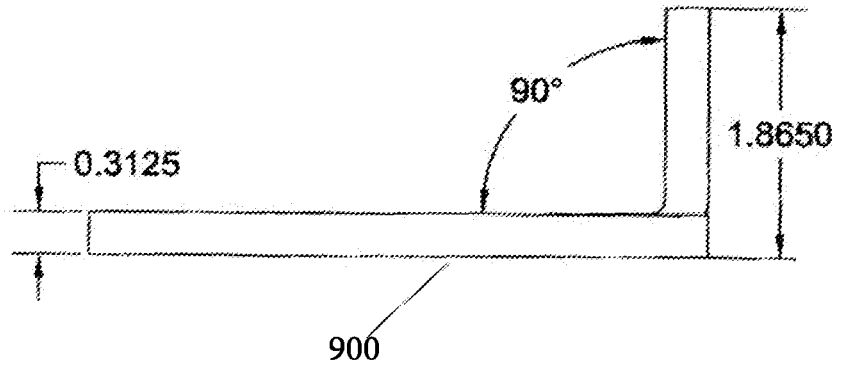
FIG. 14 is a side view of the gate pins.
Figure 14:
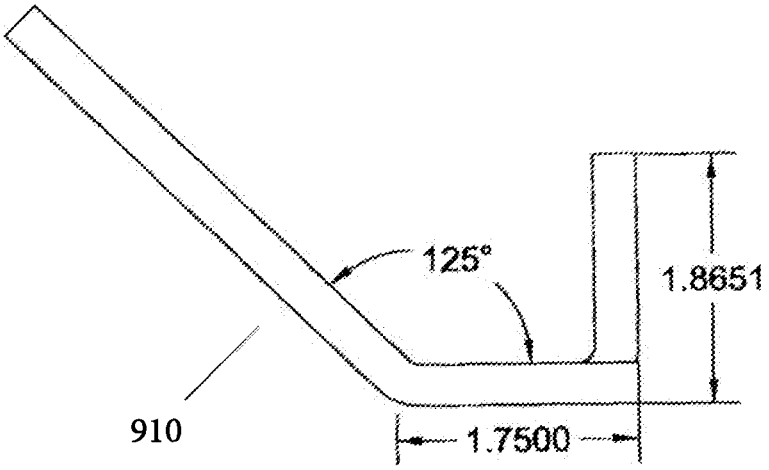
Figure 15:
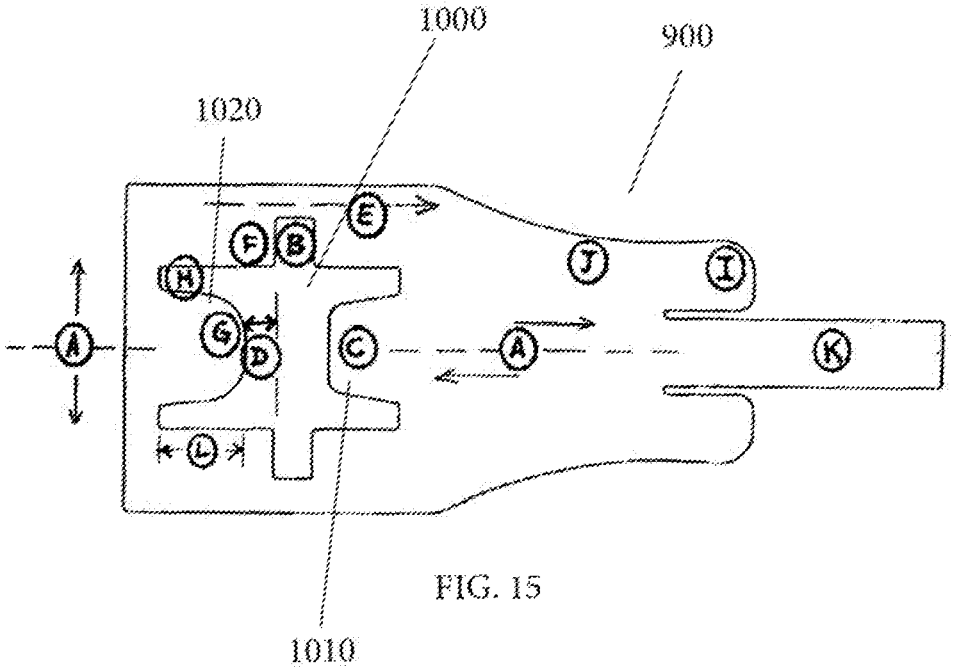
FIG. 15 is a top view of the upper gate pin, as manufactured.

Referring now to FIGS. 11, 13, and 14, the reversible design of the upper gate pin 900 allows a gate to be mounted to the left or right of a standard t-post. It includes a mounting notch 1000 which is used to clear the knobs on the t-post during installation and easily slides onto the t-post with a 1/32" clearance on three sides. The guide tongue 1010 helps to slide the gate pin onto the t-post. D as shown in FIG. 15 reflects the critical distance to lock the upper gate pin into a horizontal position when the gate is hung. The outward pressure of the gate keeps the gate pin under the knob 940 on the t-post. The entire upper gate pin 900 locks onto the t-post via pressure from the gate pulling away from post.

The curved locking tongue 1020 follows the curvature in a standard t-post. The design of the upper gate pin allows the gate to swing open to 105 degrees or more, in either direction, from the closed position in the fence. The extra length of the pin projection helps secure and add strength to the gate pin, even for a heavy gate. L is the distance between edge of tongue and end of slot; this utilizes the thickness of the gate pin metal, and reduces up and down wiggle of the gate pin. The space H is disposed to receive the projections of the t-post for extra stability as the tongue 1020 slides the distance D under the knob into communication with the interior section of the t-post.

Figure 16:
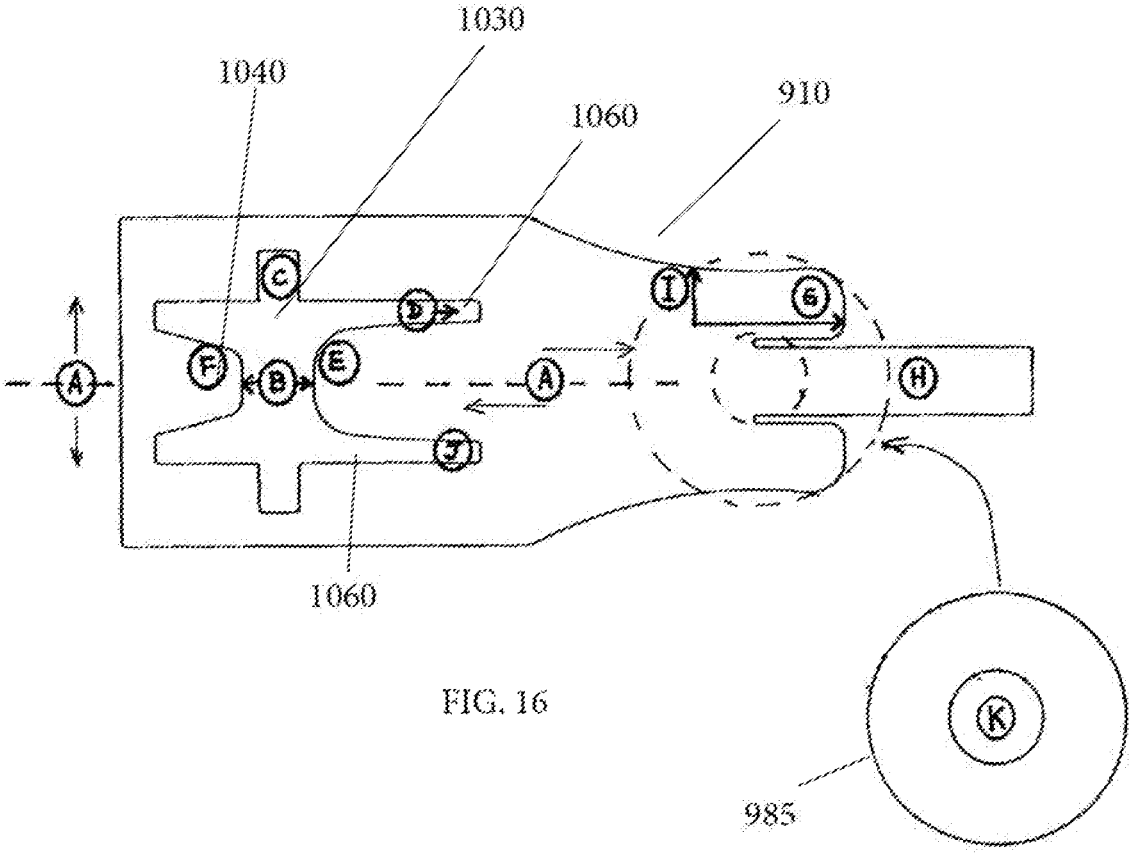
FIG. 16 is a top view of the bottom gate pin, as manufactured.

As shown in FIGS. 13 and 16, the design of the bottom gate pin also allows a gate to hang to the left or right of a standard t-post. The gap 1030 between locking tongues 1040 and 1050, with 5/16" thick steel, is needed to tilt the lower gate pin to a 45 degree angle in order to achieve the vertical position of the pin projection 980. A clearance of 1/32" on three sides of the t-post's knobs allows the lower gate pin 910 to slide down and into position on the t-post. The extended distance of slots 1060 allows t-post's wings to lock onto post when tilted down and into a 45 degree position. The curvature 1050 of the gate pin matches that of a t-post, thereby, assuring a tight fit onto the post. The rear tongue 1040 is shaped to prevent most horizontal movement when gate is hung. It also allows the lower gate pin to slip toward the gate past the knob on the post, assuring a firm and steady position. This results in the gate pin being tightly locked into position. The washer 985 is added for ease of rotating the gate. The height/length of the pin projection 980 extends past that of female part on the gate for added strength. With the top projection pointing down, this combination assures that no accidental lifting/removal of gate is possible, as discussed more fully below.

In practice, installation of a gate using the gate pins is quite simple. Referring now to FIGS. 10-13, and 17, once the t-post 950 which will serve as a gate post has been selected, the bottom gate pin 910 is slid down the gate post 950 to a desired height, e.g., a position which approximately corresponds with the lower bracket on the gate 920. This bottom gate pin 910 is then tilted and moved forward in order to securely mount it on the knobs 1090 of the gate post 950, as seen in FIGS. 10 and 12. The female lower mounting bracket of the gate 920 is then lowered onto the bottom gate pin 910 such that it is sitting on the upward facing projection of the pin. In a preferred embodiment, a washer 985 is mounted on the pin projection and the lower mounting bracket of the gate actually rests on the washer when attached. The upper gate pin 900 is then slid down the t-post 1080 until it is in a desired position, e.g. a position which corresponds with the upper bracket on the gate. The upper gate pin 900 is then moved forward to lock it into place, as shown in FIGS. 10 and 11. The upper gate pin 900 is mounted just below a t-post knob. Once locked, the knob prevents the mounting pin from being forced upward along the t-post. When in use, the weight of the gate will pull the upper gate pin along the long axis of the gate so as to apply pressure to the upper gate pin and further secure the gate in place.

The upper gate pin is positioned so that the projection from the pin body faces down, toward the ground. This is done in order to prevent an animal from lifting the gate off of the gate pins. It will be recognized that, depending on the design of the gate, it may be possible for an animal to insert its head between the sections of the gate. Such an animal might then raise its head and, under a conventional arrangement, this could force the gate up and off the mounting pins. The instant arrangement is a more secure design as it prevents the gate from being forced over the mounting projections and dismantling the gate.

When in use, the gate post 950 may sag over time due to weight of the gate 920. Alternatively, a user may desire to incline the t-post 950 away from the gate during installation in order to raise the height of the gate, i.e., raise the level of the bottom of the gate. This might be desired if, for instance, the gate was mounted on an incline or uneven terrain. In that case, a user may wish to incline the t-post so as to provide more ground clearance for the bottom of the gate. Conversely, the gate can also be lowered slightly by inclining the t-post towards the gate.

Figure 17:
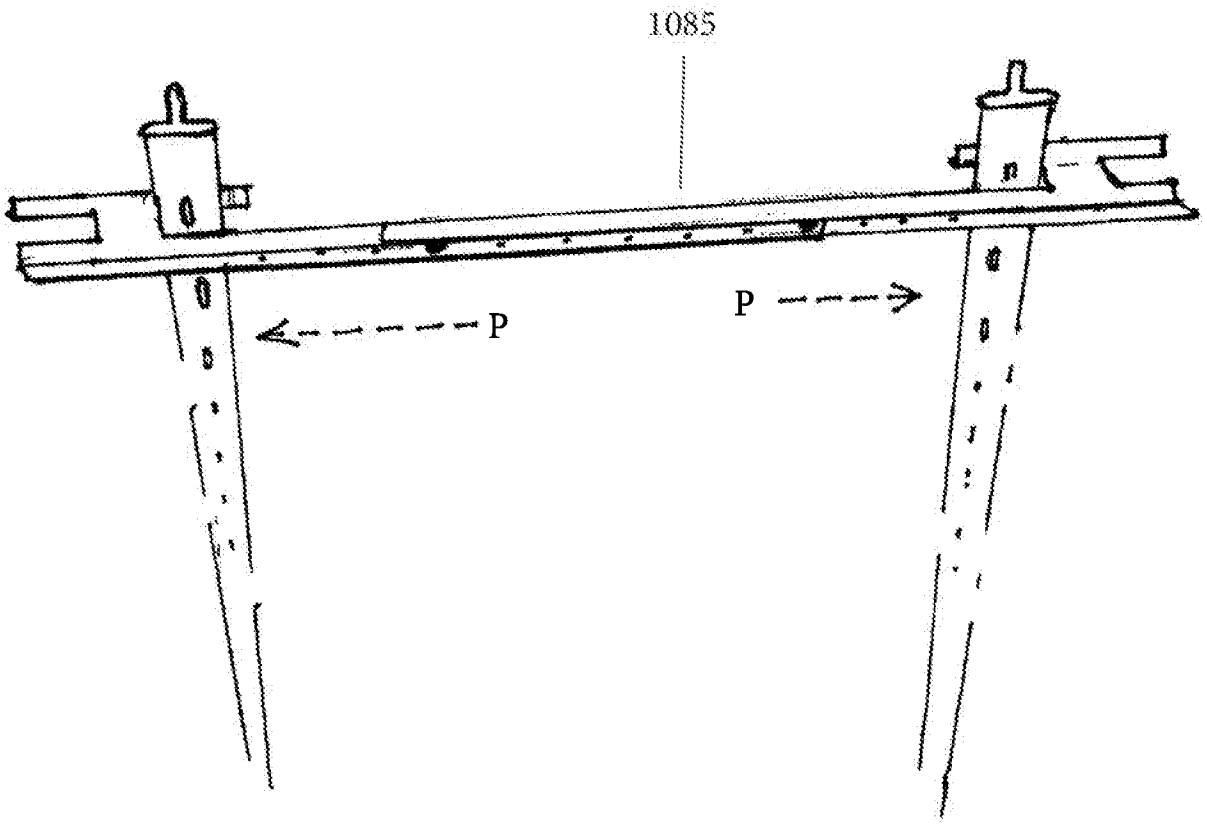
FIG. 17 is a perspective view of horizontal bracing using the invention.

The foregoing positioning can be accomplished by moving the gate post either backward or forward along the axis of the fence and securing it in position using the horizontal bracing function of this invention, an example of which is shown in FIG. 17. The length of the bracing element 1085, i.e. the horizontal brace, is adjustable so that the gate post can be inclined or tilted, in either direction, along the fence line, as desired.

Figure 18:
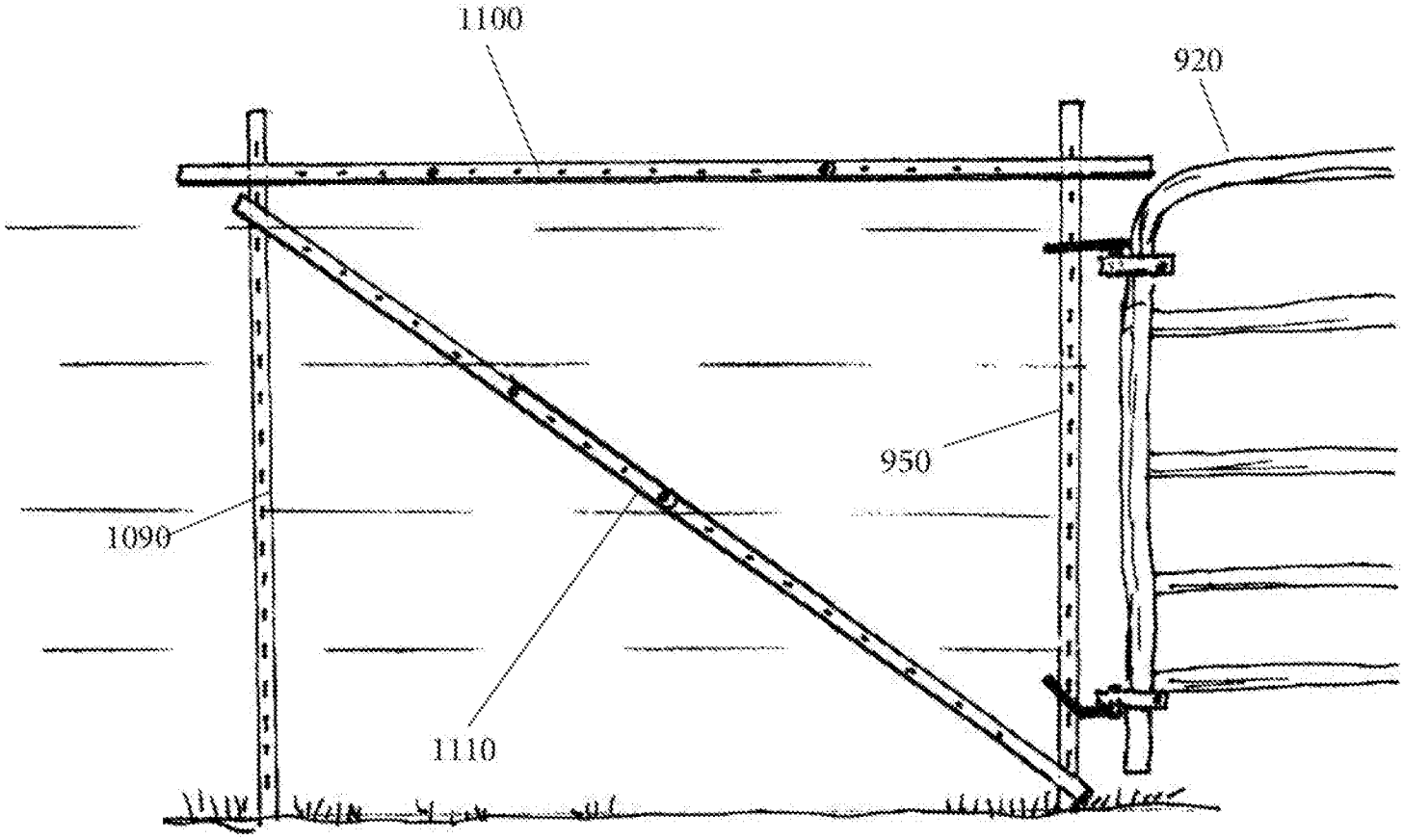
FIG. 18 is an alternate front view of a gate braced using the invention.

Referring now to FIGS. 17-18, ultimately the gate post 950 is secured to another t-post 1090 via the horizontal brace 1100 and the angled brace 1110, as shown in FIG. 18. The gate 920 is secured to the gate post 950, which is further braced by other t-posts in the fence, thereby providing a strong gate.

Figure 18A:
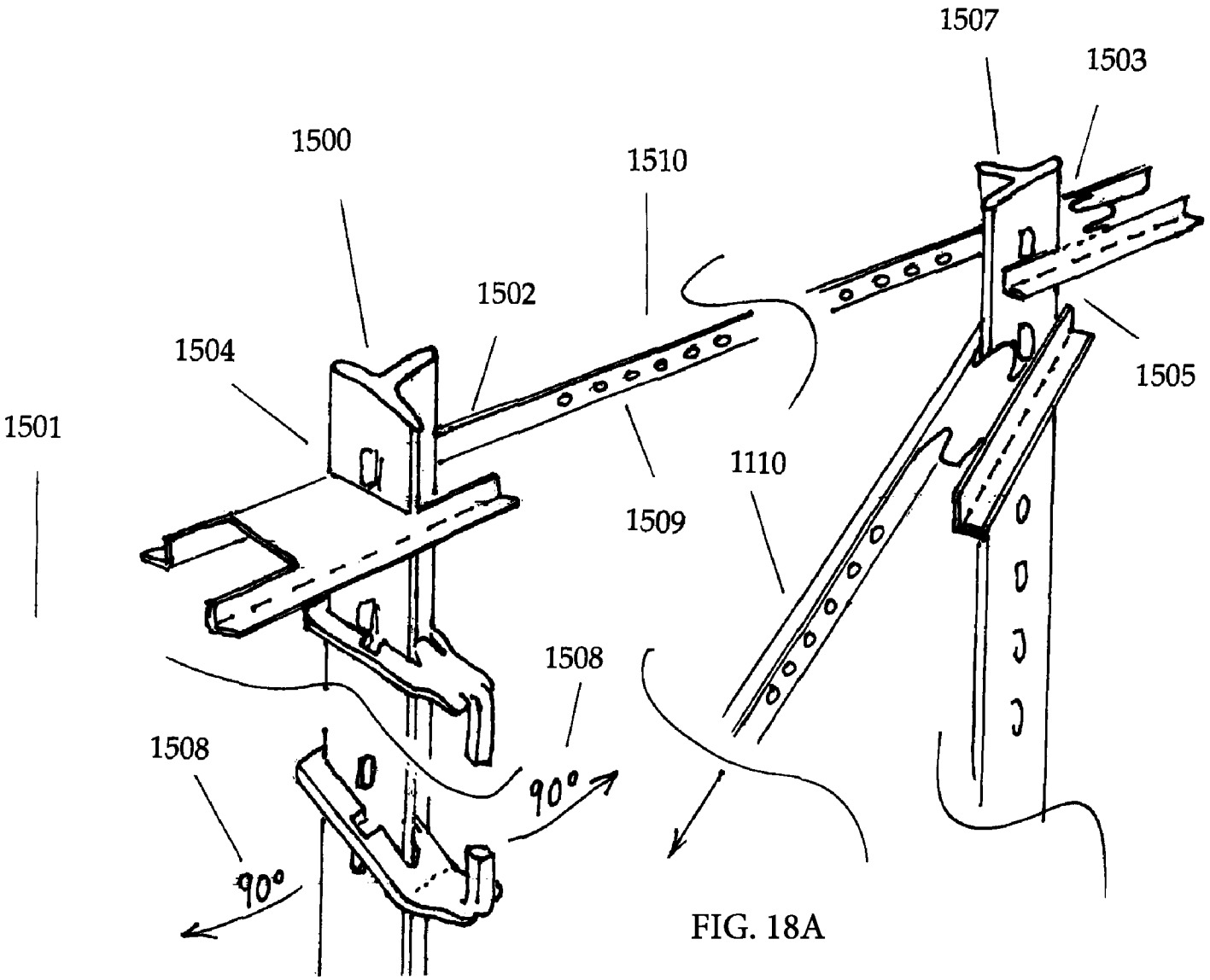
FIG. 18A is a perspective view of horizontal bracing using the invention.

The user may want to swing mounted gate 180° on one side of the fence due to a severe slop in the terrain on either side of the fence. It is also often desirable to be able to swing the gate more than just 90° to either side of the line of the fence, as not to have a single post hold the gate open in the field, away from the fence, so animals or wind will not accidentally close gate. However, the post holding the gate open may get in the way of activities on the field. A solution to the above scenarios is provided via the alternate placement of the gate post in the line fence. Instead of the hinge pins being set in line with the fence (the conventional method), the gate post is now driven into the ground with the t-post's knobs in line with the fence and facing the gate opening; this is a 45° rotation of the gate post as shown in FIG. 18A. Utilizing the foregoing method of turning the t-post 45° toward the gate opening 1501 places the mounted hinge pins at 90° to the line fence 1508. This configuration allows the gate to swing its full distance, in excess of 200°, on one side of the fence. With this option there is no single post required to hold the gate open. The closed gate is now able to swing open the entire 180° in the line fence to rest against the existing fence. The bracing for this configuration can only be accomplished by via horizontal bracing shown in FIGS. 17, and 18A. The horizontal brace 1510 in this scenario uses its wide fork back hooking function to lock onto the gate post 1500 below the t-post knob 1504 now facing toward the gate opening 1501. This not only holds the gate post vertically, but also assures that the horizontal brace 1510 does not slip off t-post. The weight of the gate adds additional stability. The opposite end of the horizontal brace 1510 terminating in the narrow key-lock fork 1503 locks below the knob 1505 on the t-post 1507 in the fence, keeping it from slipping off the post. A diagonal brace 1110, as seen in FIG. 18A, is recommended to carry the weight of any metal gate longer than four feet. The adjusting holes 1509 in the horizontal brace can be adjusted, moving the gate post back or forward, so the bottom of the gate conforms to the slope of the terrain in the fence line when shut.

Deer Flag Pins

Figures 18B, 18C:
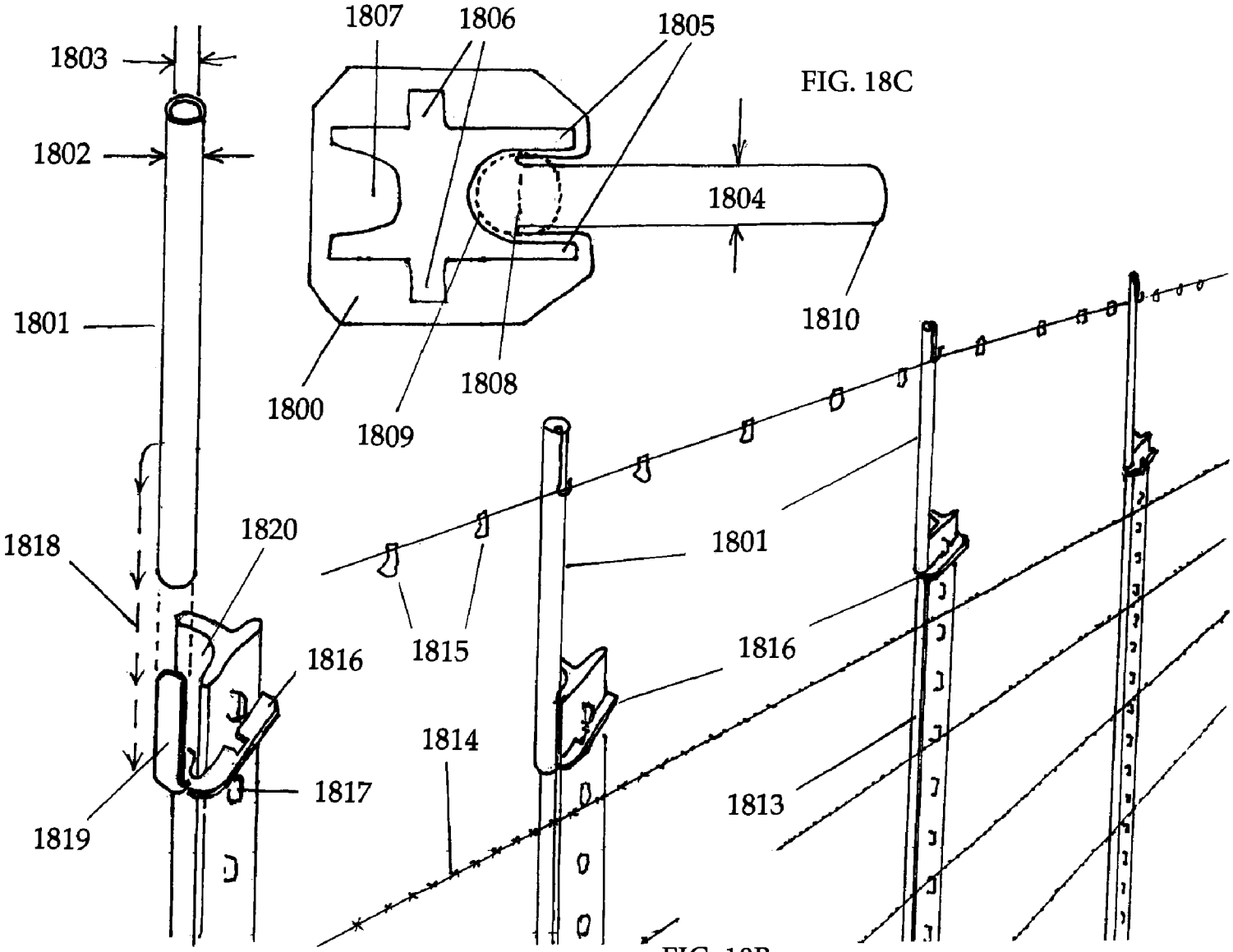
FIG. 18B is a perspective view of the fence and a planar view of a gate pin.

Deer flag pins are clips that attach to the top of a standard t-post to gain an extension of height on the t-post. Deer can jump a fence as high as two meters. The clips are designed to hold a common piece of ½ inch plastic pipe 1801. The user can choose the length of the pipe as to the height of the detraction wire 1815 the person wants. FIG. 18B provides drawing of the deer flag pin use. Part 1800 shows the basic invention as described in FIG. 12 using the special slide on action to achieve the diagonal locking of the clip. The deer flag pin is made of lightweight steel so it may be easily bent using only the fingers of the hand or small pliers. This bend 1808 is enabled as shown so when bent the center of the pin pointing up not only in line with the t-post 1813 but also in the center of the plastic pipe that will slide over, 1804, or as viewed in 1819. The bend 1808 is designed to conform to the tongue 1809. The deer flag clips slide onto t-post by the cutouts 1806 and the rear tongue 1807 to allow a smooth downward motion onto the t-post. The extended notches 1805 are designed to tilt down on the projections of the t-post and lock into a 45° angle. From that downward angle the user bends the pin 1804 up, parallel with the t-post. The extension pipe used is ½ inch ID (inside diameter 1803). The pin 1819 as shown in bent position is far enough off the curvature from the t-post, 1820 so pipe 1801 with ID 1803 can slip over exact dimension of, 1804 with its rounded tip 1810 for ease of male and female union 1818. The deer flag pins 1816 when slipped down, angled and bent, will rest on t-post 1813 just above a post's knob, 1817 and will be prevented from slipping down further. When the overall thickness of the pipe 1802 is on section 1819, the distance 1820 is minimal so the pipe extensions are vertically ridged. The perspective view shown in 18B shows a fence wire and distracting flags 1815 hanging from pipe extensions 1801 which are mounted by clips 1816 onto t-posts 1813 and connected by fence wire 1814 attached to the lower portions of the t-posts 1813.

T-Post Removal

Figure 19:
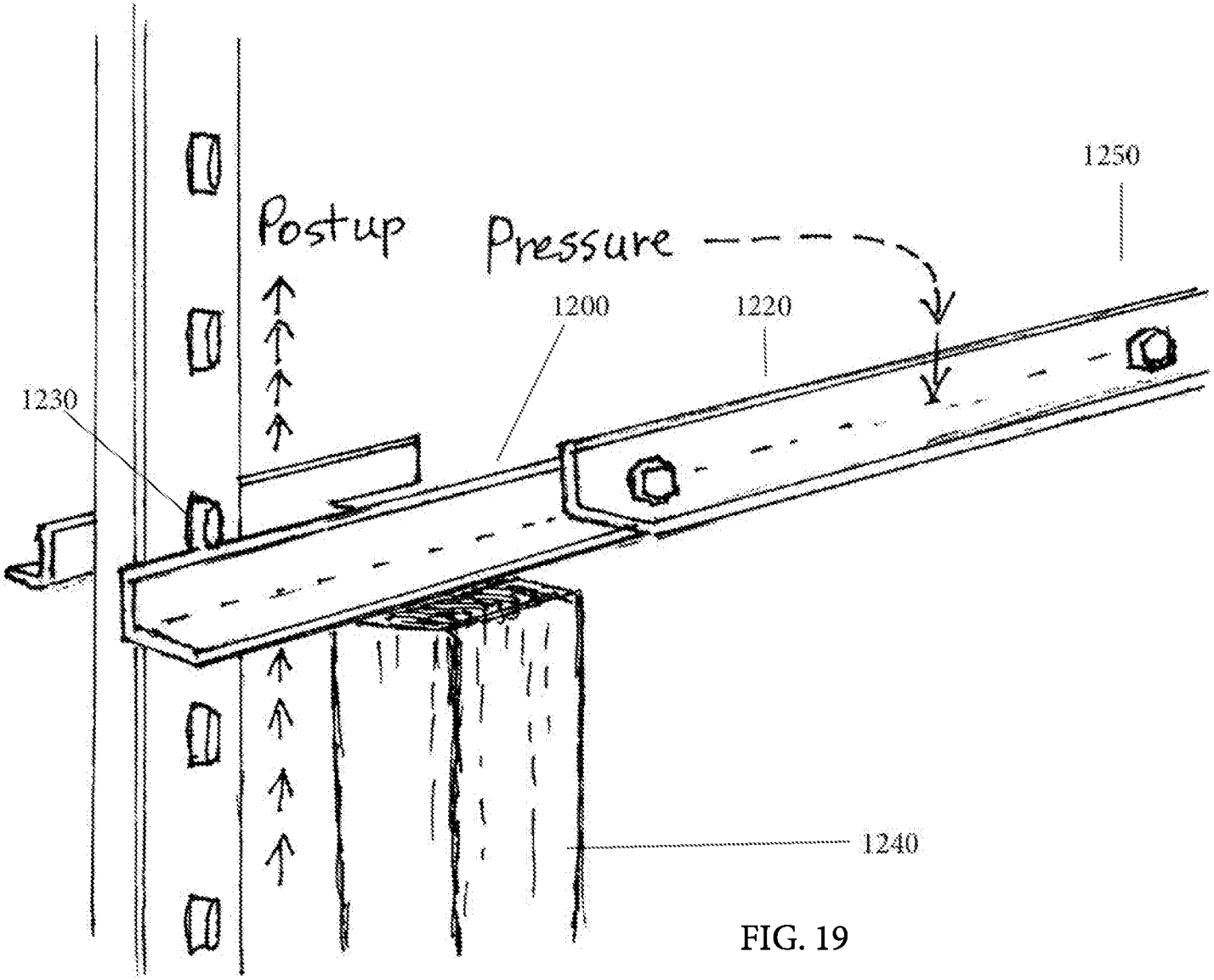
FIG. 19 is an illustration of the t-post removal function.

The locking brace 100 may also be used as a tool to assist with the removal of a t-post that has been driven into the ground. Referring to FIG. 19, the key-lock fork 1200 end of a locked locking brace 1220 is positioned just below a knob projection 1230 on a t-post that the user desires to remove from the ground. A fulcrum 1240, in this embodiment a 2×4 wood block, is then placed below, and essentially perpendicular to, the key lock fork section 1200. The locking brace 1220 is first shortened to the minimum length such that the two sections of the body 110 overlap. Pressure is then applied to the opposite end 1250 of the locking brace in a downward direction as shown in FIG. 19. Using the locking brace as a lever in this fashion permits one to apply considerable force to the t-post in order to drive the t-post up and out of the ground. This reduces the amount of work that must be done and, more importantly, eliminates the need for any additional tools or equipment to accomplish the removal task.

Wire Stretch Bracket

The system also includes a removable wire-stretch bracket that can be positioned, as necessary, in order to assist in stretching fencing wire between metal-t-posts. The bracket snaps onto a respective t-post providing a location to receive a wire stretcher. The bracket is reversible, i.e., it can be mounted from either direction on the t-post, so it can be used for stretching in either direction, left or right. The bracket permits an ordinary wire stretcher to "hook" to the bracket and then rotate about the wire-stretch bracket until the fencing wire is taut.

Figure 20:
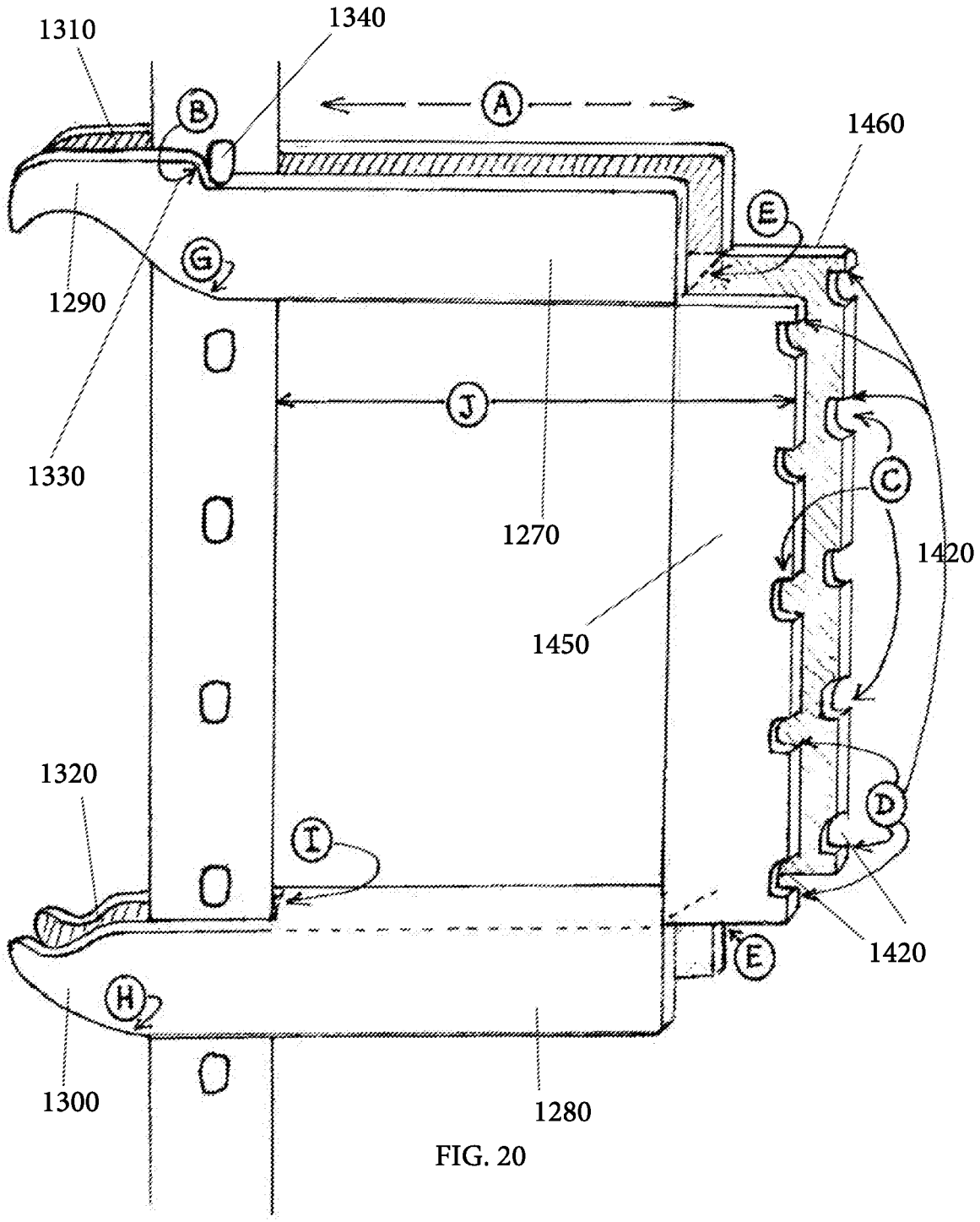
FIG. 20 is a perspective view of the wire-stretch bracket.
Figure 21:
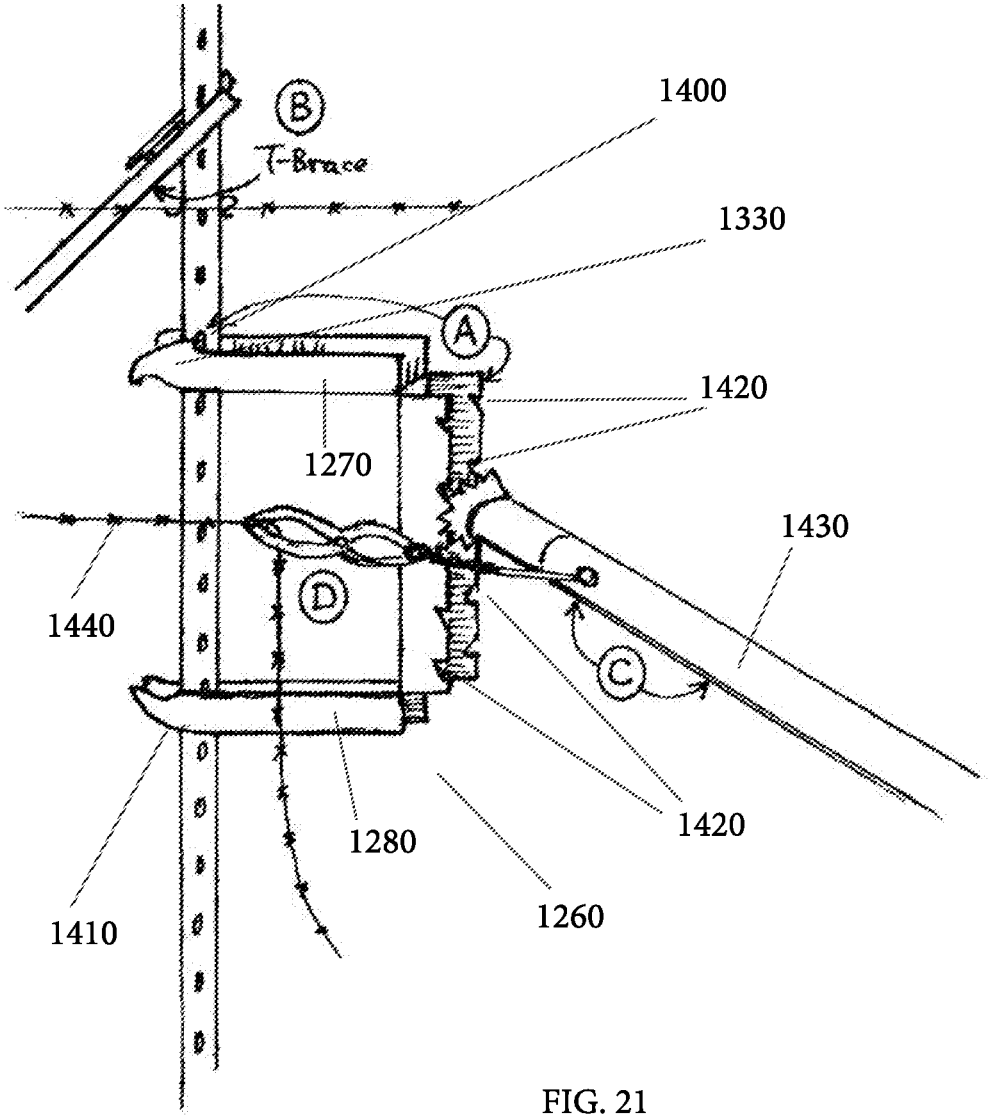
FIG. 21 is a perspective view of the wire-stretch bracket in use.

Referring now to FIGS. 20-21, the wire-stretch bracket 1260 is essentially C-shaped with upper 1270 and lower 1280 retention arms. Each arm ends in a u-shaped projection 1290, 1300 which is capable of sliding on either side of a t-post when in use. The open areas 1310, 1320 within the center of the u-shaped projections are disposed to accept the body of the t-post when the bracket 1260 is mounted for use. The u-shaped projection 1310 on the upper arm 1290 includes a limiting notch 1330 which, when the bracket 1260 is installed, contacts the knob 1340 on the t-post; this prevents backward travel of the wire-stretch bracket 1260 once it has been mounted. The tongues 1350, 1360 on the bracket 1260 assure that the bracket is sturdily locked onto the t-post when pressure from the stretching tool is applied. The distance, J, allows a user to grab, pull, and stretch wire, thereby creating adequate space to easily clip fencing wire onto the t-post. The curvature of the bracket, G, and the distance between points 1370 and 1380 assist in guiding the bracket through the space provided between knobs on the t-post.

The extended lip or protrusion of the bracket beyond the t-post, F, facilitates alignment of the fencing wire. When securing the wire to a t-post, the wire can be pushed or moved down or up into a horizontal position, by using a pipe, hammer handle, or similar implement, so as achieve the desired right angle orientation to the t-post.

When in use, as shown in FIG. 21, the wire-stretch bracket 1260 snaps onto a t-post 1390 at two locations, a first, upper location 1400 between two "knobs" and a second lower location 1410 between two other "knobs". The wire-stretch bracket 1260 is mounted by sliding the top u-projection at a downward angle onto the t-post at a location between two t-post knobs. Then the bracket 1260 is straightened, relative to the ground such that the top surface is then generally parallel to the ground, resulting in the bottom u-projection being rotated onto the lower location of the t-post, again between two t-post knobs. The two u-brackets are then seated between the respective t-post knobs. The upper notch prevents the bracket from traveling backward and falling off of the t-post. The wire-stretch bracket can be mounted in either direction on the t-post so as to stretch wire from either the left or the right of any particular t-post.

In the preferred embodiment, there are four sets of stretching grooves 1420. Each set of grooves is composed of a notch on the left flange 1450 and a notch on the right flange 1460. The notches are shaped such that the upper portion of the two upper notches (A) and the lower portion of the two bottom notches (B) extend essentially perpendicular from the respective flange.

The stretching grooves 1420 are disposed to receive the teeth from a wire stretcher 1430. The teeth fit into the notches and one can then pivot about the notch in order to stretch the fence wire 1440 as shown in FIG. 21. The notches also help maintain the position and stability of the wire stretcher while stretching and prevent the wire-stretcher from slipping off of the bracket 1260 when in use.

While the invention has been described in reference to certain preferred embodiments, it will be readily apparent to one of ordinary skill in the art that certain modifications or variations may be made to the device without departing from the scope of invention described in the foregoing specification.

The invention claimed is:

1. An adjustable t-post support bracket comprising:

an elongated L-shaped body having a first end terminating in a key-lock section and a second end terminating in an angle-lock section; said body possessing a plurality of apertures along the length of said body;

a key-lock fork at the terminus of said key-lock section; said key-lock fork including the first end of said L-shaped body, a center portion extending orthogonally from an edge of said L-shaped body, and a flange; said center portion having a first tongue and a second tongue, each said tongue having two sides;

a first upper channel disposed between said L-Shaped body and a first side of said first tongue; a second upper channel disposed between said flange and a second side of said first tongue;

a first lower channel disposed between said L-Shaped body and a first side of said second tongue; a second lower channel disposed between said flange and a second side of said second tongue; and, a wide angle fork at the terminus of said angle-lock section; said wide angle fork including the second end of said L-shaped body, a center portion extending orthogonally from an edge of said L-shaped body, and a flange.

2. The adjustable fence support bracket of claim 1 further including a hinge pin.

3. The adjustable fence support bracket of claim 1 wherein said hinge pin comprises a nut and a bolt.

4. The adjustable fence support bracket of claim 1 further including a locking pin.

5. The adjustable fence support bracket of claim 1 wherein said locking pin comprises a nut and a bolt.

* * * * *